US010528005B2

(12) United States Patent
Semon et al.

(10) Patent No.: US 10,528,005 B2
(45) Date of Patent: Jan. 7, 2020

(54) MECHANISM FOR A TIMEPIECE AND TIMEPIECE HAVING SUCH A MECHANISM

(71) Applicant: LVMH SWISS MANUFACTURES SA, La Chaux-de-Fonds (CH)

(72) Inventors: Guy Semon, Neuchatel (CH); Wout Johannes Benjamin Ypma, Delft (NL); Nima Tolou, The Hague (NL)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 0 days.

(21) Appl. No.: 15/534,852

(22) PCT Filed: Dec. 9, 2015

(86) PCT No.: PCT/EP2015/079119
§ 371 (c)(1),
(2) Date: Jun. 9, 2017

(87) PCT Pub. No.: WO2016/091951
PCT Pub. Date: Jun. 16, 2016

(65) Prior Publication Data

US 2018/0017941 A1 Jan. 18, 2018

(30) Foreign Application Priority Data

Dec. 9, 2014 (EP) ..... 14197015

(51) Int. Cl.
*G04B 17/04* (2006.01)
*G04B 15/06* (2006.01)

(52) U.S. Cl.
CPC ..... *G04B 17/045* (2013.01); *G04B 15/06* (2013.01)

(58) Field of Classification Search
CPC ..... G04B 17/04; G04B 17/045; G04B 15/06; G04B 15/08; G04B 15/14
See application file for complete search history.

(56) References Cited

U.S. PATENT DOCUMENTS 2,481,213 A 9/1949 Gummersall
7,458,717 B2 * 12/2008 Baumberger ..... G04B 15/06 368/127

(Continued)

FOREIGN PATENT DOCUMENTS

EP 2 613 205 A2 7/2013
EP 2 645 189 A1 10/2013
WO WO 2011/120180 A1 10/2011

OTHER PUBLICATIONS

International Search Report related to Application No. PCT/EP2015/079119 dated Mar. 7, 2016.

*Primary Examiner* — Sean P Kayes
(74) *Attorney, Agent, or Firm* — Miller, Matthias & Hull LLP

(57) ABSTRACT

A mechanism for a timepiece, comprising a an oscillating regulator mechanism, a rotary energy distribution toothed wheel, a blocking mechanism controlled by the regulator mechanism to alternatively hold and release the energy distribution wheel, and a monostable elastic member linked to the regulator mechanism and bearing on the teeth of the energy distribution wheel. The teeth of the energy distribution wheel are adapted to elastically deform the monostable elastic member by cam effect during rotation of the wheel, and the monostable elastic member is adapted to elastically return to its rest position, thus releasing mechanical energy to the regulator mechanism.

24 Claims, 36 Drawing Sheets

(56) References Cited

U.S. PATENT DOCUMENTS

| | | | | |
|---|---|---|---|---|
| 8,087,819 | B2 * | 1/2012 | Chiuve | G04B 15/06 368/127 |
| 8,303,167 | B2 | 11/2012 | Dehon | |
| 8,540,418 | B2 * | 9/2013 | Richard | G04B 43/002 368/128 |
| 9,075,394 | B2 * | 7/2015 | Stranczl | G04B 15/00 |
| 9,207,640 | B2 | 12/2015 | Stranczl et al. | |
| 9,304,493 | B2 | 4/2016 | Stranczl et al. | |
| 2008/0219103 | A1 * | 9/2008 | Baumberger | G04B 15/06 368/131 |
| 2008/0279052 | A1 * | 11/2008 | Rochat | G04B 15/06 368/131 |
| 2015/0043313 | A1 | 2/2015 | Stranczl et al. | |
| 2015/0103636 | A1 | 4/2015 | Stranczl et al. | |

* cited by examiner

MECHANISM FOR A TIMEPIECE AND TIMEPIECE HAVING SUCH A MECHANISM

CROSS-REFERENCE TO RELATED APPLICATION

This Application is a 35 USC § 371 US National Stage filing of International Application No. PCT/EP2015/079119 filed on Dec. 9, 2015, and claims priority under the Paris Convention to European Patent Application No. 14197015.2 filed on Dec. 9, 2014.

FIELD OF THE DISCLOSURE

The invention relates to mechanisms for timepieces and to timepieces having such mechanisms.

BACKGROUND OF THE DISCLOSURE

Document U.S. Pat. No. 8,303,167B2 discloses a mechanism for a timepiece, comprising a regulator mechanism having a periodical movement, two rotary escapement wheels, a blocking mechanism cooperating with the escapement wheels, said distributor mechanism being controlled by the regulator mechanism to regularly and alternatively hold and release the escapement wheels so that said escapement wheels rotate step by step, and an bistable elastic member configured to be cyclically deformed in a predetermined way to store energy, and to release this energy to the regulator mechanism by elastic return.

This mechanism is very complex, hence costly, and includes a large number of parts moving with frictional losses, which limits the energetic efficiency of the system.

SUMMARY OF THE DISCLOSURE

One objective of the present invention is to at least mitigate these drawbacks.

To this end, according the invention proposes a mechanism for a timepiece, comprising:

- a regulator mechanism adapted to oscillate with a periodical movement;
- an energy distribution member having teeth;
- a blocking mechanism cooperating with the energy distribution member, said blocking mechanism being controlled by the regulator mechanism to regularly and alternatively hold and release the energy distribution member, so that said energy distribution member may move step by step according to a repetitive movement cycle;
- a monostable elastic member linked to the regulator mechanism and adapted to bear on the teeth of the energy distribution member, said monostable elastic member normally having a first geometrical configuration, said monostable elastic member being arranged such that during each movement cycle of the energy distribution member:
- one tooth of said energy distribution member elastically deforms said monostable elastic member from said first geometrical configuration;
- and then said monostable elastic member elastically returns to the first geometrical configuration, thereby releasing mechanical energy to the regulator mechanism.

Thanks to these dispositions, the mechanism is simpler in structure and way of operating, thus less costly, more reliable and better in terms of energetic efficiency.

In various embodiments of the mechanism according to the invention, one may possibly have recourse in addition to one and/or other of the following arrangements:

- said monostable elastic member is arranged such that during each movement cycle of the energy distribution member, one tooth of said energy distribution member elastically deforms said monostable elastic member from said first geometrical configuration to a predetermined, second geometrical configuration of the monostable elastic member, said second geometrical configuration being the same for all movement cycles of the energy distribution member, whereby said monostable elastic member releases a predetermined, constant amount of mechanical energy to the regulator mechanism when it elastically returns to the first geometrical configuration: the mechanism thus ensures energy transfers to the regulator mechanism which are substantially constant and independent of the torque applied to the energy distribution wheel. In particular, the elastic deformation of the monostable elastic member are the same at each movement cycle, due to the geometry of the mechanism, and therefore the mechanical energy which is accumulated in the monostable elastic member during deformation and then released to the regulator mechanism, is constant;
- said energy distribution member is a rotary energy distribution wheel;
- said monostable elastic member is a flexible tongue which has a first end linked to the regulator mechanism and a second, free end bearing on the teeth of the energy distribution wheel;
- the regulator mechanism has an inertial regulating member which is mounted on a support by a first elastic suspension and the blocking mechanism has a blocking member which is connected to the regulating member by at least an elastic link so as to move in synchronism with said regulating member, said blocking member being connected to the monostable elastic member and cooperating with the energy distribution member to alternatively hold and release said energy distribution member;
- said blocking member is connected to the regulating member so as to oscillate with a frequency twice an oscillation frequency of the regulating member: this feature enables to increase the frequency of the stepwise rotations of the energy distribution wheel, which in turn enables to control the timepiece movement with higher temporal precision;
- the regulating member and the first elastic suspension are arranged so that said regulating member oscillates in two directions from a neutral position, between first and second extreme regulating member positions, the blocking member is mounted to oscillate between first and second extreme locking member positions, and the elastic link is arranged such that:
  - the blocking member is moved to the second extreme blocking member position by the elastic link when the regulating member is in the neutral position; and
  - the blocking member is moved to the first extreme blocking member position by the elastic link when the regulating member is in any of the first and second extreme regulating member positions;
- said energy distribution member is a rotary energy distribution wheel and said blocking member has first and second stop members which are arranged to interfere in turn with said teeth of the energy distribution wheel so as to hold said energy distribution wheel respectively when said blocking member is in the first and second extreme blocking member positions, said first stop member being arranged to not interfere with the energy distribution wheel when the blocking member is between a first escape position and the second extreme blocking member position, and said second stop member being arranged to not interfere with the energy distribution wheel when the blocking member is between a second escape position and the first extreme blocking member position;

the energy distribution wheel is movable in a direction of rotation and the teeth of said energy distribution wheel have respectively a front face facing the direction of rotation and a rear face opposite the direction of rotation, and the first and second stop members are arranged such that:

when said blocking member is in the first escape position and the first stop member is in correspondence with the front face of a tooth, the second stop member is between two other teeth of the energy distribution wheel, in the vicinity of the rear face of one of these two other teeth;

when said blocking member is in the second escape position and the second stop member is in correspondence with the front face of a tooth, the first stop member is between two other teeth of the energy distribution wheel, in the vicinity of the rear face of one of these two other teeth;

the mechanism further includes biasing means for biasing the energy distribution wheel in rotation through a mechanical transmission, in a single direction of rotation, and said transmission is arranged such that each rotation step of the energy distribution wheel is completed in a time which is not longer than a time necessary for the blocking member to travel from the first escape position to the second extreme blocking member position;

said monostable elastic member is arranged such that the teeth of the energy distribution wheel elastically deform said monostable elastic member from said first geometrical configuration to said second geometrical configuration during rotation of the energy distribution wheel when the blocking member is between the first escape position and the second extreme blocking member position;

the monostable elastic member is arranged such that said monostable elastic member is in the second geometrical configuration when the blocking member is in the second extreme blocking member position, whereby the monostable elastic member returns to the first geometric configuration and then transfers said predetermined amount of mechanical energy to the blocking member during movement of the blocking member from the second extreme blocking member position to the second escape position, the elastic link being arranged to transmit said predetermined amount of mechanical energy to the regulating member: this feature particularly enhances the energetic efficiency of the mechanism, since the elastic deformations of the monostable elastic member accompany the movement of the blocking member instead of opposing to this movement;

the monostable elastic member is arranged not to interfere with the teeth of the energy distribution wheel while the blocking member moves from the second escape position to the first extreme blocking member position and from said first extreme blocking member position to the first escape position;

the monostable elastic member is mounted on the blocking member adjacent the second stop member;

said blocking member is mounted on the support by a second elastic suspension;

said first elastic suspension is arranged to impose either a translational movement, or a rotational movement to the regulating member, and said second elastic suspension is arranged to impose either a translational movement, or a rotational movement to the blocking member;

said first elastic suspension is arranged to impose a translational movement to the regulating member in a first direction, and said second elastic suspension is arranged to impose a translational movement to the blocking member in a second direction substantially perpendicular to said first direction;

the first elastic suspension comprises two flexible, first elastic branches extending substantially parallel to the second direction and the second elastic suspension comprises two flexible, second elastic branches extending substantially parallel to the first direction, and the blocking member is connected to the regulating member by at least two flexible elastic links extending substantially parallel to the second direction;

said first elastic branches and said flexible elastic links are arranged to be substantially rectilinear when the regulating member is in neutral position: this feature enhances precision of the elastic deformation of the monostable elastic member, thus enhancing precision of the amount of energy transferred to the regulator mechanism each time the monostable elastic member returns to its first geometrical configuration;

said energy distribution member is a rotary energy distribution wheel and said first and second stop members and said second elastic suspension are arranged such that said first and second stop members move substantially radially with regard to the energy distribution wheel, alternately toward and away from said energy distribution wheel;

the mechanism has one single energy distribution wheel;

the regulator mechanism, the blocking mechanism and the monostable elastic member are a monolithic system made in a single plate and designed to move essentially in a mean plane of said plate;

the mechanism includes a fixed stop having a predetermined position relative to a support on which the energy distribution member is mounted, the monostable elastic member is connected to a decoupled support which is elastically linked to the regulator mechanism by an elastic connection, said stop is positioned so as to said decoupled support as long as one tooth of said energy distribution member elastically deforms said monostable elastic member from said first geometrical configuration, and said elastic connection is rigid enough to maintain said decoupled support in abutment with said stop while said energy distribution member elastically deforms said monostable elastic member;

the decoupled support is elastically linked to the blocking member by said elastic connection;

the position of said stop is adjustable relative to the support.

Besides, the invention also concerns a timepiece having a mechanism as defined above.

BRIEF DESCRIPTION OF THE DRAWINGS

Other features and advantages of the invention appear from the following detailed description of one embodiment thereof, given by way of non-limiting example, and with reference to the accompanying drawings.

In the drawings.

DETAILED DESCRIPTION OF THE DISCLOSURE

In the Figures, the same references denote identical or similar elements.

Figure 1:
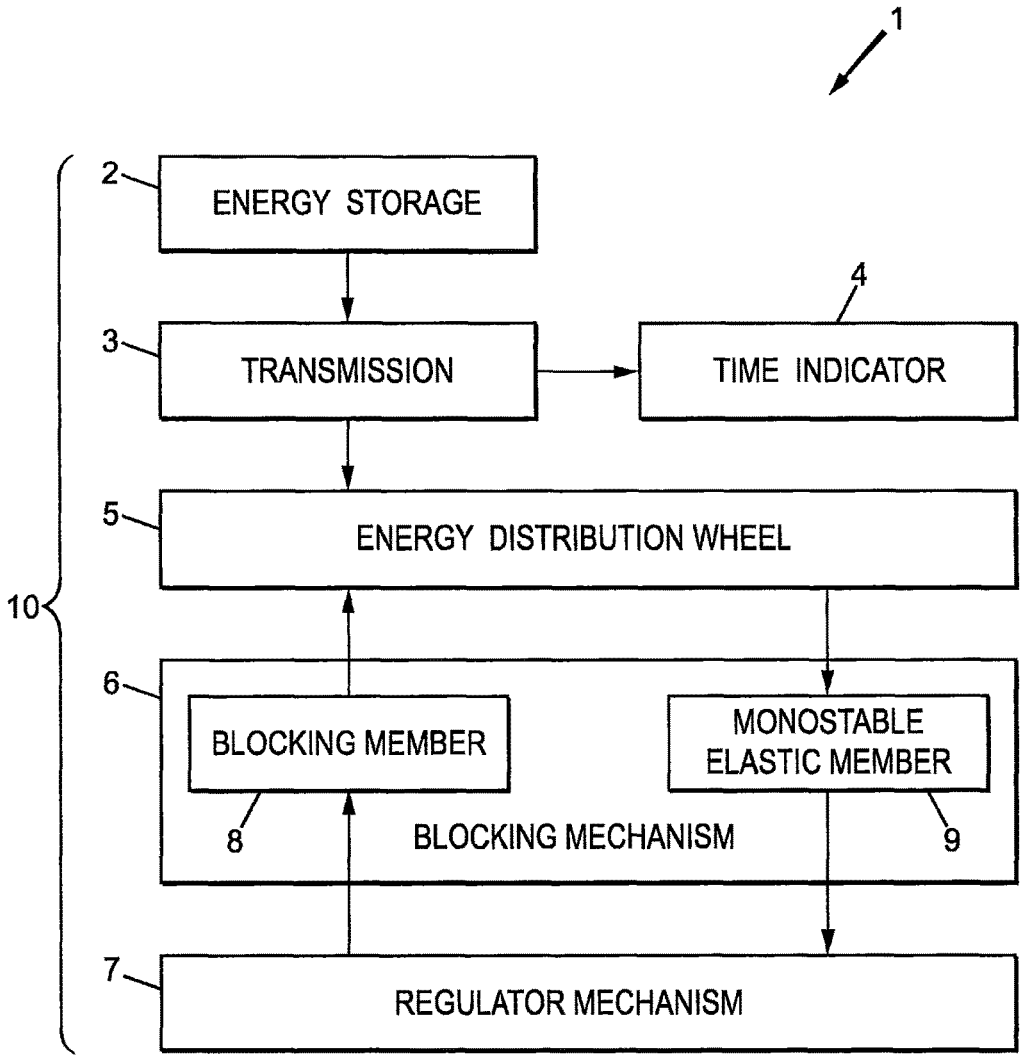
FIG. 1 is a schematic bloc diagram of a mechanical timepiece, according to the invention.

FIG. 1 shows a schematic bloc diagram of a mechanical timepiece 1, for instance a watch, including at least the following:

- a mechanical energy storage 2;
- a transmission 3 powered by the energy storage 2;
- one or several time indicator(s) 4, for instance watch hands driven by the transmission 3;
- an energy distribution member 5 driven by the transmission 3;
- a blocking mechanism 6 having for instance a blocking member 8 adapted to sequentially hold and release the energy distribution member 5 so that said energy distribution member may move step by step according to a repetitive movement cycle, of a constant travel at each movement cycle;
- a regulator mechanism 7, which is an oscillating mechanism controlling the blocking mechanism to move it regularly in time so that the hold and release sequence of the blocking mechanism be of constant duration, thus giving the tempo of the movement of the energy distribution wheel 5, the transmission 3 and the time indicators 4.

The energy distribution member may be a rotary energy distribution wheel 5. The following description will be made with respect to such energy distribution wheel.

The mechanical energy storage 2 is usually a spring, for instance a spiral shaped spring usually called main spring. This spring may be wound manually through a winding stem and/or automatically through an automatic winding powered by the movements of the user.

The transmission 3 is usually a gear comprising a series of gear wheels (not shown) meshing with one another and connecting an input shaft to an output shaft (not shown). The input shaft is powered by the mechanical energy storage 2 and the output shaft is connected to the energy distribution wheel. Some of the gear wheels are connected to the watch hands or other time indicators 4.

The transmission 3 is designed so that the energy distribution wheel rotates much more quickly than the input shaft (with a speed ratio which may be for instance of the order of 3000).

The regulator mechanism 7 is designed to oscillate with a constant frequency, thus ensuring the timepiece's precision. The oscillation of the regulator is sustained by regular transfers of mechanical energy from the energy distribution wheel 5, through a monostable elastic member 9 which may for instance belong to the blocking mechanism 6.

The mechanical energy storage 2, transmission 3, energy distribution wheel 5, blocking mechanism 6 and regulator 7 form together a timepiece movement 10.

The particular embodiment of FIGS. 2-9 will now be described in details.

Figure 2:
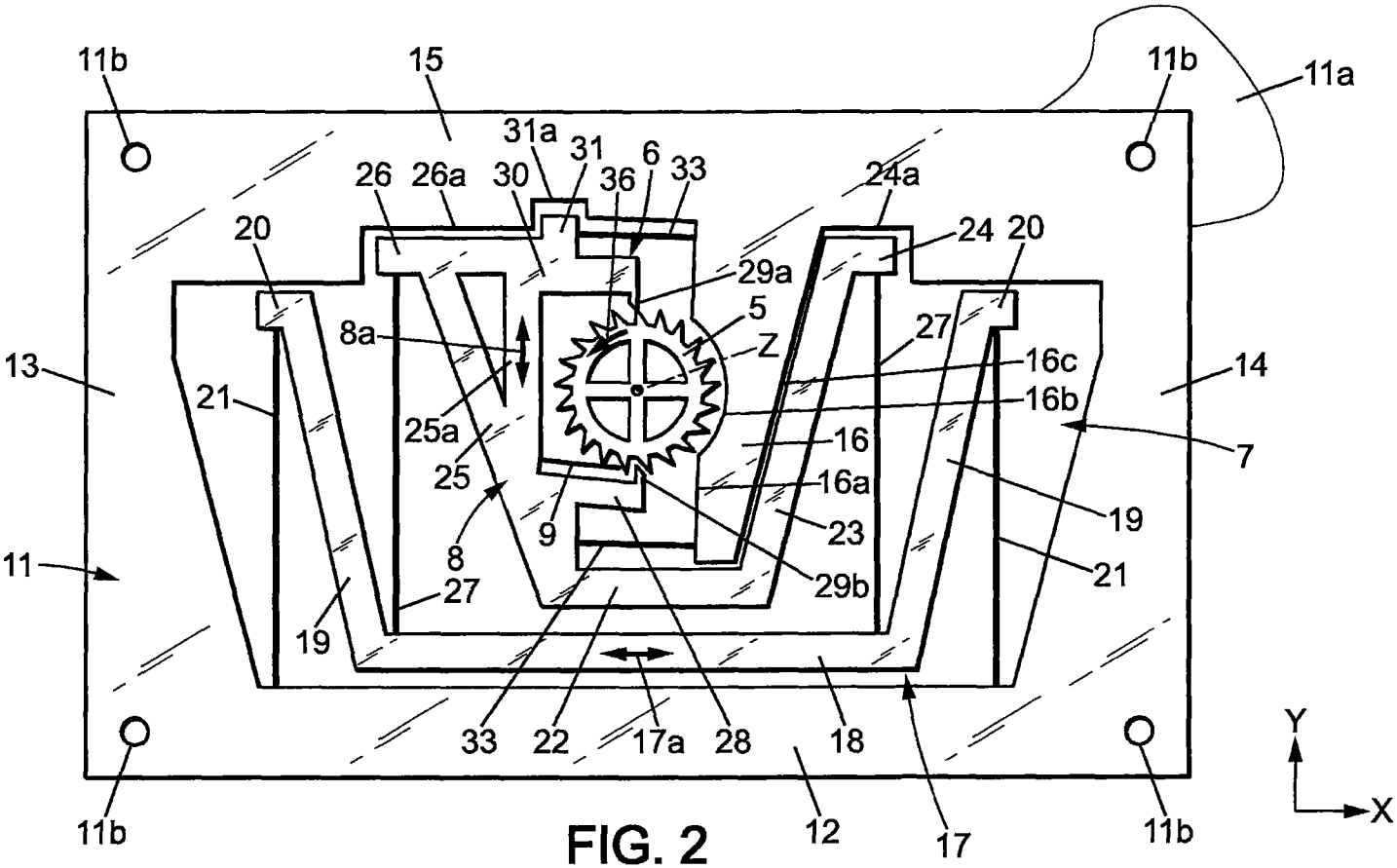
FIG. 2 is a plan view of a mechanism for a mechanical timepiece, including a regulator mechanism, a blocking mechanism and an energy distribution wheel according to a first embodiment of the invention.
Figure 2A:
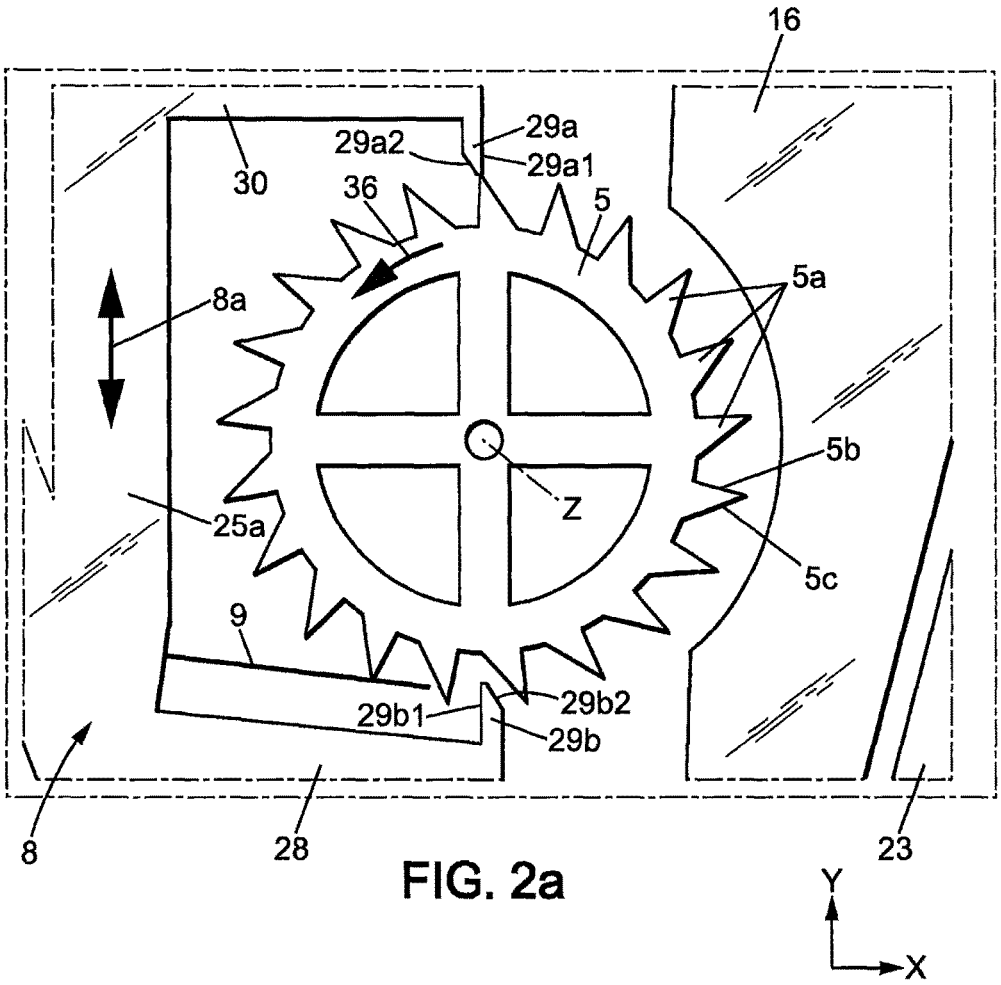
FIG. 2*a* shows details of the blocking mechanism and energy distribution wheel of FIG. 2.

In this embodiment, the blocking mechanism 6 and regulator mechanism 7 may be monolithic and made in a single plate 11, as shown for instance in FIGS. 2 and 2*a*. Plate 11 is usually planar.

The plate 11 may have a small thickness, e.g. about 0.1 to about 0.6 mm, depending of the material thereof.

The plate 11 may have transversal dimensions, in the plane of said plate (e.g. width and length, or diameter), comprised between about 15 mm and 40 mm.

The plate 11 may be manufactured in any suitable material, preferably having a relatively high Young modulus to exhibit good elastic properties. Examples of materials usable for plate 11 are: silicon, nickel, steel, titanium. In the case of silicon, the thickness of plate 11 may be for instance comprised between 0.3 and 0.6 mm.

The various members of the blocking mechanism 6 and regulator mechanism 7, which will be detailed hereafter, are formed by making cutouts in plate 11. These cutouts may be formed by any manufacturing method known in micromechanics, in particular for the manufacture of MEMS.

In the case of a silicon plate 11, plate 11 may be locally hollowed out for instance by Deep Reactive Ion Etching (DRIE), or in some cases by solid state laser cutting (in particular for prototyping or small series).

In the case of a nickel plate 11, the blocking mechanism 6 and regulator mechanism 7 may be obtained for instance by LIGA.

In the case of a steel or titanium plate 11, plate 11 may be locally hollowed out for instance by Wire Electric Discharge Machining (WEDM).

The constituting parts of the blocking mechanism 6 and regulator mechanism 7, each formed by portions of plate 11, by will now be described in details. Some of these parts are rigid and others are elastically deformable, usually in flexion. The difference between so-called rigid parts and so-called elastic parts is their rigidity in the plane of plate 11, due to their shape and in particular to their slenderness. Slenderness may be measured for instance by the slenderness ratio (ratio of length of the part on width of the part). Parts of high slenderness are elastic (i.e. elastically deformable) and parts of low slenderness are rigid. For instance, so-called rigid parts may have a rigidity in the plane of plate 11, which is at least about 1000 times higher than the rigidity of so-called elastic parts in the plane of plate 11. Typical dimensions for the elastic connections, e.g. elastic branches 21, 33 and elastic links 27 described below, include a length comprised for instance between 5 and 13 mm, and a width comprised for instance between 0.01 mm (10 μm) and 0.04 mm (40 μm), e.g. around 0.025 mm (25 μm).

Plate 11 forms an outer frame which is fixed to a support plate 11*a* for instance by screws or similar through holes 11*b* of the plate 11. The support plate 11*a* is in turn fixed in the timepiece casing.

In the example shown on FIG. 2, plate 11 forms a closed, rigid frame entirely surrounding the blocking mechanism 6 and regulator mechanism 7, but this frame could be designed otherwise and in particular could be designed to not surround or not surround totally the blocking mechanism 6 and regulator mechanism 7. In the example shown on FIG. 2, such fixed frame includes two substantially parallel sides 12, 15 extending in a first direction X and two substantially parallel sides 13, 14 extending in a second direction Y which is substantially perpendicular to the first direction X. Frame 12-15, support plate 11*a* and all other fixed parts may be referred to herein as "a support".

The energy distribution wheel 5 is pivotally mounted relative to the support, around an axis of rotation Z which is perpendicular to the plate 11. The energy distribution wheel 5 is biased by energy storage 2 through transmission 3 in a single direction of rotation 36.

The energy distribution wheel 5 has external teeth 5*a*, each having a front face 5*b* facing the direction of rotation 36 and a rear face 5*c* opposite the direction of rotation 36.

For instance, the front face 5*b* can extend in a radial plane which is parallel to the rotation axis Z, while the rear face 5*c* may extend parallel to axis Z and slantwise relative to the radial direction (see FIG. 2*a*).

It should be noted that the teeth 5*a* do not need to have the complex shape of a classical escapement wheel of a so-called Swiss-lever escapement or Swiss-anchor escapement.

The monostable elastic member 9 is linked to the regulator mechanism 7 and is adapted to bear on the teeth 5*a* of the energy distribution wheel 5. The monostable elastic member 9 normally has a first geometrical configuration (rest position) and the teeth 5*a* of the energy distribution wheel are adapted to elastically deform said monostable elastic member 9 by cam effect from said first geometrical configuration to a second geometrical configuration. The monostable elastic member 9 is arranged such that during each rotation cycle of the energy distribution wheel 5:

- one tooth 5*a* of said energy distribution wheel elastically deforms said monostable elastic member 9 from said first geometrical configuration to said second geometrical configuration of the monostable elastic member;
- and then said monostable elastic member 9 elastically returns to the first geometrical configuration, thereby releasing a predetermined amount of mechanical energy to the regulator mechanism 7.

The regulator mechanism may have a rigid, inertial regulating member 17 which is connected to the frame of the plate 11 by a first elastic suspension 21. The first elastic suspension may comprise for instance two flexible, first elastic branches 21 extending substantially parallel to the second direction Y, from the side 12 of the plate 11 so that the regulating member 17 is movable in translation substantially parallel to the first direction X with respect to the support. The regulating member 17 and the first elastic suspension 21 are arranged so that said regulating member 17 oscillates in two directions from the neutral position shown on FIG. 2, according to the double arrow 17*a* visible on FIG. 2, between two extreme positions which will be called here "first and second extreme regulating member positions".

The translation movement of regulating member 17 may be substantially rectilinear.

Advantageously, the regulating member 17 is mounted on the support to oscillate in circular translation, with a first amplitude of oscillation in the first direction X and a non-zero, second amplitude of oscillation in the second direction Y. Preferably, the first amplitude of oscillation is at least 10 times the second amplitude, which makes the movement substantially rectilinear.

The regulating member 17 may have a main rigid body 18 extending longitudinally substantially parallel to the first direction X close to the side 12 of plate 11, two diverging rigid arms 19 extending from the ends of the main body 18 toward the side 15 of plate 11, up to respective free ends 20. The free ends 20 may extend outwardly opposite to each other, substantially parallel to the first direction X.

The first elastic branches 21 may have first ends connected to the side 12 of plate 11, respectively close to sides 13, 14 of plate 11, and second ends respectively connected to the free ends 20 of the arms 19. The first elastic branches 21 may be substantially rectilinear (i.e. not flexed) when the regulating member 17 is at rest in the neutral position.

The length of first elastic branches 21 and the amplitude of oscillation of regulating member 17 are such that the movement of said regulating member 17 is substantially rectilinear, as explained above.

The blocking mechanism 6 has a rigid blocking member 8 which is connected to the regulating member 17 by at least an elastic link 27 so as to move in synchronism with said regulating member 17.

In the example shown on FIG. 2, the blocking member may be connected to the regulating member 17 by two flexible elastic links 27 extending substantially parallel to the second direction Y. Said flexible elastic links 27 may be arranged to be substantially rectilinear (non-flexed) when the regulating member 17 is in neutral position.

The blocking member 8 may be mounted on the frame of the plate 11 by a second elastic suspension 33. The second elastic suspension 33 may be arranged to impose a translational movement to the blocking member 8 in the second direction Y. The second elastic suspension may comprise two flexible, second elastic branches 33 extending substantially parallel to the first direction X, so that blocking member 8 is movable in translation substantially parallel to the second direction Y, in direction of double arrows 8*a*. The blocking member is thus movable in two opposite directions from a neutral position, between two extreme positions called here "first and second extreme blocking member positions". The elastic branches 33 may be arranged so as to be substantially rectilinear (not flexed) when the blocking member 8 is at rest in the neutral position.

In the example shown on FIG. 2, the blocking member 8 may include:

- a rigid base 22 close to the main body 18 of regulating member 17 and extending longitudinally in the first direction X, and
- two diverging rigid lateral arms 23, 25 extending from the ends of the base 22 toward the side 15 of plate 11, up to respective free ends 24, 26. The free ends 24, 26 may extend outwardly opposite to each other, substantially parallel to the first direction X.

The elastic links 27 may have first ends connected to main body 18 of regulating member 17, close to the ends thereof, and second ends respectively connected to the free ends 24, 26 of the arms 23, 25.

Besides, the free end 26 of the lateral arm 25 may be extended toward the other lateral arm 23, in the first direction X, by a first transversal, rigid arm 30. The lateral arm 25 may also be extended, toward the other lateral arm 23, in the first direction X, by a second rigid transversal arm 28 which is close to the base 22. The energy distribution wheel 5 is between first and second transversal arms 30, 28.

The respective free ends of the first and second transversal arms 30, 28 may have respectively first and second stop members 29*a*, 29*b*. First and second stop members 29*a*, 29*b* may be in the form of rigid fingers protruding toward each other from the free ends of first and second transversal arms 30, 28, in the second direction Y.

First and second stop members 29*a*, 29*b* are designed to cooperate with the teeth 5*a* of the energy distribution wheel 5, as will be explained in more details below, to alternately hold and release said energy distribution wheel 5. First and second stop members 29*a*, 29*b* may have a stop face, respectively 29*a*1, 29*b*1, facing the front face 5*b* of the teeth, and an opposite rear face, respectively 29*a*2, 29*b*2. The stop faces 29*a*1, 29*b*1 may preferably be disposed in a radial plane parallel to axis Z, while the rear faces 29*a*2, 29*b*2 may extend slantwise so that the stop members 29*a*, 29*b* have pointed shapes.

Blocking member 8 may further include a strut 25 *a*, extending in the second direction Y and joining the lateral arm 25 to the first transversal arm 30.

Blocking member 8 may further have a tab 31 extending in the second direction Y from the transversal arm 30, toward the side 15 of plate 11.

The free end 26 and first transversal arm 30 may be received with small play in an indent 26*a* cut out in the side 25 of plate 11. In addition, tab 31 may be received in a further indent 31*a* cut out in the side 15 of plate 11.

Plate 11 may further include a rigid tongue 16, extending in the second direction Y from the side 15 of plate 11 toward side 12, between the energy distribution wheel 5 and the lateral arm 23 of the blocking member 8. Tongue 16 may have a first edge 16*a* facing the energy distribution wheel 5 and extending parallel to the second direction Y. The first edge 16*a* may have a concave, circular cut out 16*b* partly receiving the energy distribution wheel 5. Tongue 16 further has a second edge 16*c* opposite the first edge and facing the lateral arm 23. The second edge 16*c* may be slanted parallel to the lateral arm 23, and be in close vicinity to lateral arm 23.

One of the second elastic branches 33 may have a first end connected to the first edge 16*a* of the tongue 16, close to the side 15 of plate 11, and a second end connected to the tab 31. The other of the second elastic branches 33 may have a first end connected to the first edge 16*a* of the tongue 16, close to the free end of the tongue 16, and a second end connected to the lateral arm 25 close to the base 22.

The blocking member 8 may be connected to the monostable elastic member 9. In particular, said monostable elastic member may be a flexible tongue 9 which has a first end connected to the blocking member 8 (and therefore linked to the regulator mechanism 7 through flexible links 27) and a second, free end bearing on the teeth 5*a* of the energy distribution wheel 5. Typical dimensions for the flexible tongue 9 include a length comprised between for instance 3 and 5 mm, and a width comprised for instance between 0.01 mm (10 μm) and 0.04 mm (40 μm), for instance around 0.025 mm (25 μm).

The flexible tongue 9 may be mounted on the blocking member 8 adjacent the second stop member 29*b*. In particular, the flexible tongue may be connected to the lateral arm 25 of the blocking member 8, close to the transversal arm 28. The flexible tongue 9 may extend substantially parallel to the first direction X, between the transversal arm 28 and the energy distribution wheel 5, up to a free end which is close to the second stop member 29*b*.

The flexible tongue 9 and blocking member 8 being two distinct members, the mechanism thus provides a separation between the function of blocking/releasing the distribution wheel 5 (provided by the blocking member 8) and the function of transferring energy to the regulator mechanism to sustain oscillation thereof (provided by the flexible tongue 9). Thanks to this separation of functions, the design of the blocking member 8 doesn't need to take into account the function of transferring energy (as it is the case in a traditional Swiss-anchor escapement which handles both blocking and energy transferring functions) and the design of the flexible tongue 9 doesn't need to take into account the function of blocking/releasing the distribution wheel 5.

During operation, regulating member 17 oscillates in translation parallel to the first direction X, with a frequency f comprised for instance between 20 and 30 Hz, and blocking member 8 oscillates with a frequency 2*f*, twice the oscillation frequency of the regulating member 17.

More precisely, the elastic links 27 are arranged such that:

the blocking member 8 is moved to the second extreme blocking member position by the elastic link 27 (toward the side 15) when the regulating member 17 is in the neutral position; and the blocking member 8 is moved to the first extreme blocking member position (toward the side 12) by the elastic links 27 when the regulating member 17 is in any of the first and second extreme regulating member positions.

During this movement, the first and second stop members 29*a*, 29*b* move substantially radially with regard to the energy distribution wheel 5, alternately toward and away from said energy distribution wheel, and the first and second stop members 29*a*, 29*b* thus interfere in turn with the teeth 5*a* of the energy distribution wheel 5 so as to hold said energy distribution wheel 5 respectively when said blocking member 8 is in the first and second extreme blocking member positions.

More precisely, the first stop member 29*a* is arranged to:

hold the energy distribution wheel 5 when the blocking member is moving between the first extreme blocking member position (close to side 12) and a first escape position (position where the apex of first stop member 29*a* is in correspondence with the outer diameter of the teeth 5*a*), and not interfere with the energy distribution wheel 5 when the blocking member 8 is between said first escape position and the second extreme blocking member position (close to side 15).

Besides, the second stop member 29*b* is arranged to:

hold the energy distribution wheel 5 when the blocking member is moving between the second extreme blocking member position (close to side 15) and a second escape position (position where the apex of second stop member 29*b* is in correspondence with the outer diameter of the teeth 5*a*);

and not interfere with the energy distribution wheel 5 when the blocking member 8 is between said second escape position and the first extreme blocking member position (close to side 12).

Further, the second escape position of blocking member 8 may be between the first extreme blocking member position (close to side 12) and the first escape position. In that case, advantageously, the first and second stop members 29*a*, 29*b* are arranged such that:

when said blocking member 8 is in the first escape position and the first stop member 29*a* is in correspondence with the front face 5*b* of a tooth 5*a*, the second stop member 29*b* is between two other teeth 5*a* of the energy distribution wheel, in the vicinity of the rear face 5*c* of one of these two other teeth;

when said blocking member 8 is in the second escape position and the second stop member 29*b* is in correspondence with the front face 5*b* of a tooth 5*a*, the first stop member 29*a* is between two other teeth 5*a* of the energy distribution wheel, in the vicinity of the rear face 5*c* of one of these two other teeth.

The flexible tongue 9 may be arranged such that the teeth 5*a* of the energy distribution wheel 5 elastically deform said monostable elastic member 9 from said first geometrical configuration to said second geometrical configuration during rotation of the energy distribution wheel 5 when the blocking member 8 is between the first escape position and the second extreme blocking member position. Thus, the flexible tongue 9 accumulates a predetermined potential mechanical energy, corresponding to the geometrical deformation thereof between the predetermined first geometrical configuration and the predetermined second geometrical configuration. This predetermined energy is the same at each rotation cycle of the energy distribution wheel 5.

The flexible tongue 9 may be arranged such that said flexible tongue 9 is in the second geometrical configuration when the blocking member 8 is in the second extreme blocking member position. Thus, the flexible tongue 9 returns to the first geometric configuration and transfers said predetermined amount of mechanical energy to the blocking member 8 during movement of the blocking member 8 from the second extreme blocking member position to the second escape position. The elastic links 27 are arranged to transmit said predetermined amount of mechanical energy to the regulating member 17.

Further, the flexible tongue 9 may be arranged not to interfere with the teeth 5*a* of the energy distribution wheel 5 while the blocking member 8 moves from the second escape position to the first extreme blocking member position and from said first extreme blocking member position to the first escape position.

Preferably, the transmission 3 is such that each rotation step of the energy distribution wheel 5 is completed in a time which is not longer than the time necessary for the blocking member 8 to travel from the first escape position to the second extreme blocking member position.

The operation of the mechanism will now be described step by step, with regard to FIGS. 3, 3*a*-9, 9*a*.

Figure 3:
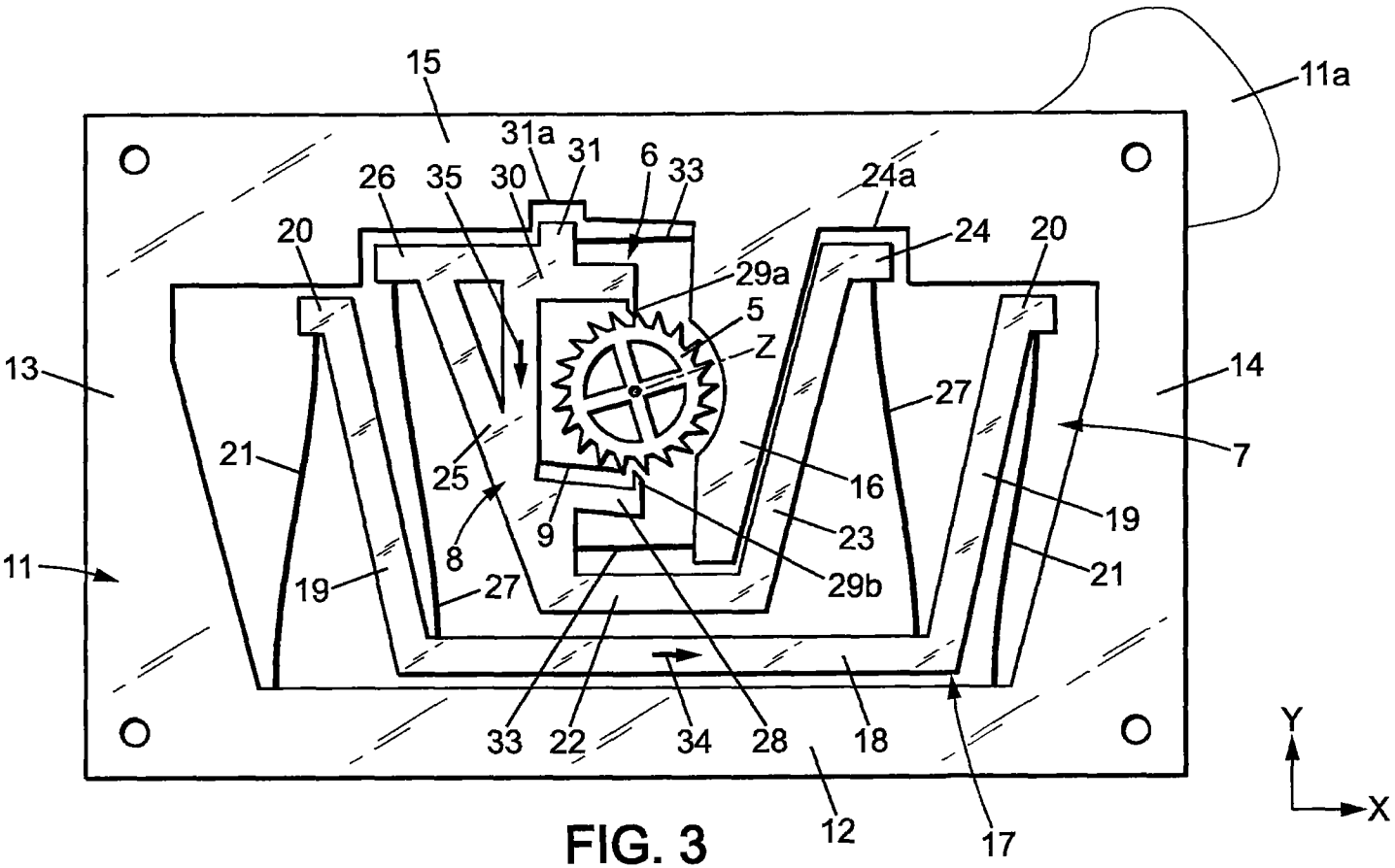
FIGS. 3,3*a* to 9,9*a* are views similar to FIGS. 2 and 2*a*, respectively illustrating successive movements of the mechanism of FIG. 2 in substantially half a period of the regulating mechanism.
Figure 3A:
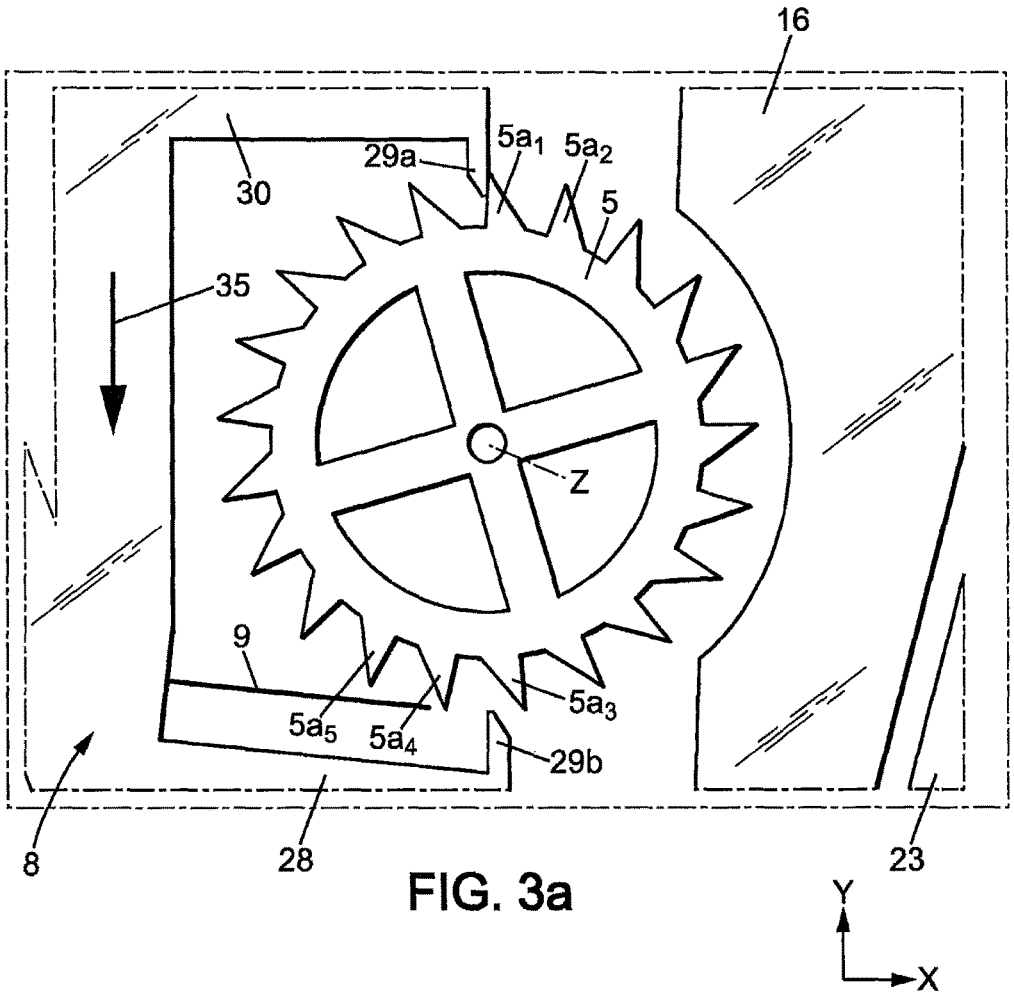

In the position of FIGS. 3 and 3*a:* regulating member 17 is moving toward side 14 in the direction of arrow 34 and is close to the second extreme regulating member position;

blocking member 8 is moving toward side 12 in the direction of arrow 35 and is close to the first blocking member regulating member position, so that energy distribution wheel 5 is held by the first stop member 29*a;* second stop member 29*b* does not interfere with the energy distribution wheel 5;

flexible tongue 9 is in the first geometric position (rest position).

For a better understanding, reference numerals have been given to some of the teeth 5*a* on FIGS. 3*a*-9*a*. The situation of these teeth is as follows in the position of FIG. 3*a:* tooth $\mathbf{5}a_1$ is the tooth which is held by the first stop member 29*a;* tooth $\mathbf{5}a_2$ is the next tooth which will move toward the first stop member 29*a* in the direction of rotation 36 at the next rotation step of the energy distribution wheel 5;

teeth $\mathbf{5}a_3$ and $\mathbf{5}a_4$ are situated respectively past and before the second stop 29*b* member in the direction of rotation 36 of the energy distribution wheel 5;

tooth $\mathbf{5}a_4$ is the next tooth to move toward second stop member 29*b* after tooth $\mathbf{5}a_4$ in the direction of rotation 36 of the energy distribution wheel 5.

Figure 4:
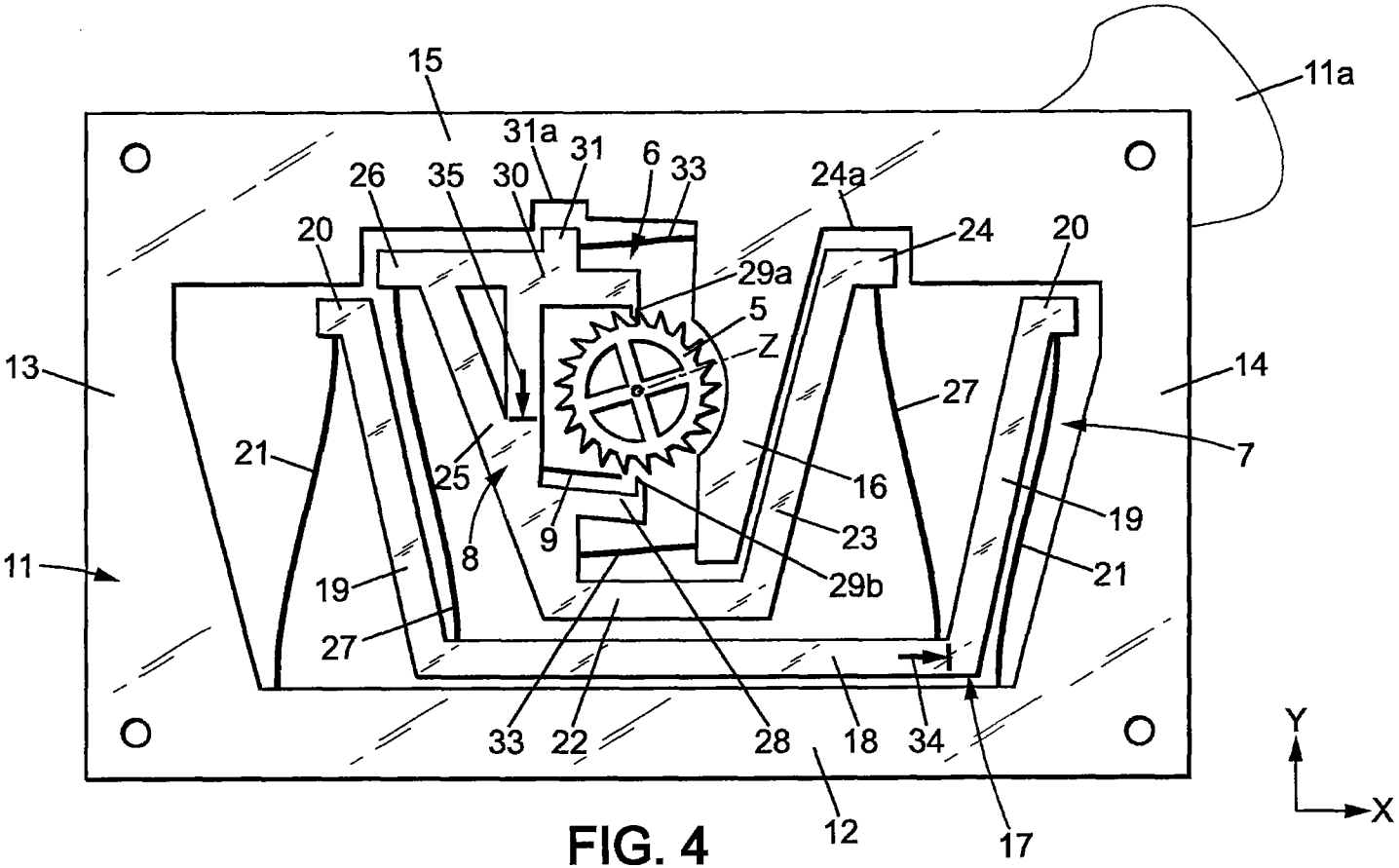
Figure 4A:
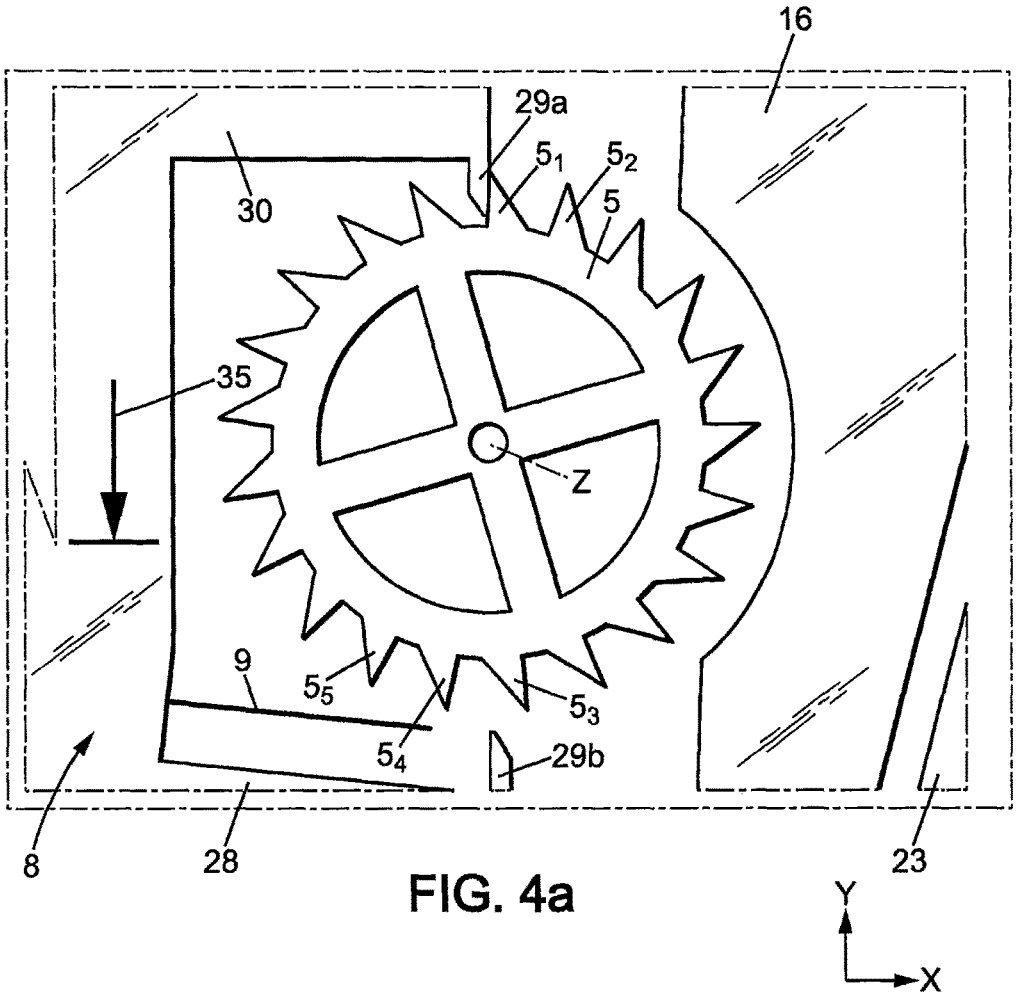

The mechanism then arrives in the position of FIGS. 4, 4*a*, where:

regulating member 17 arrives in the second extreme regulating member position;

blocking member 8 arrives in the first extreme blocking member position, and energy distribution wheel 5 is still held by the first stop member 29*a;* flexible tongue 9 is still in the first geometric position (rest position).

Figure 5:
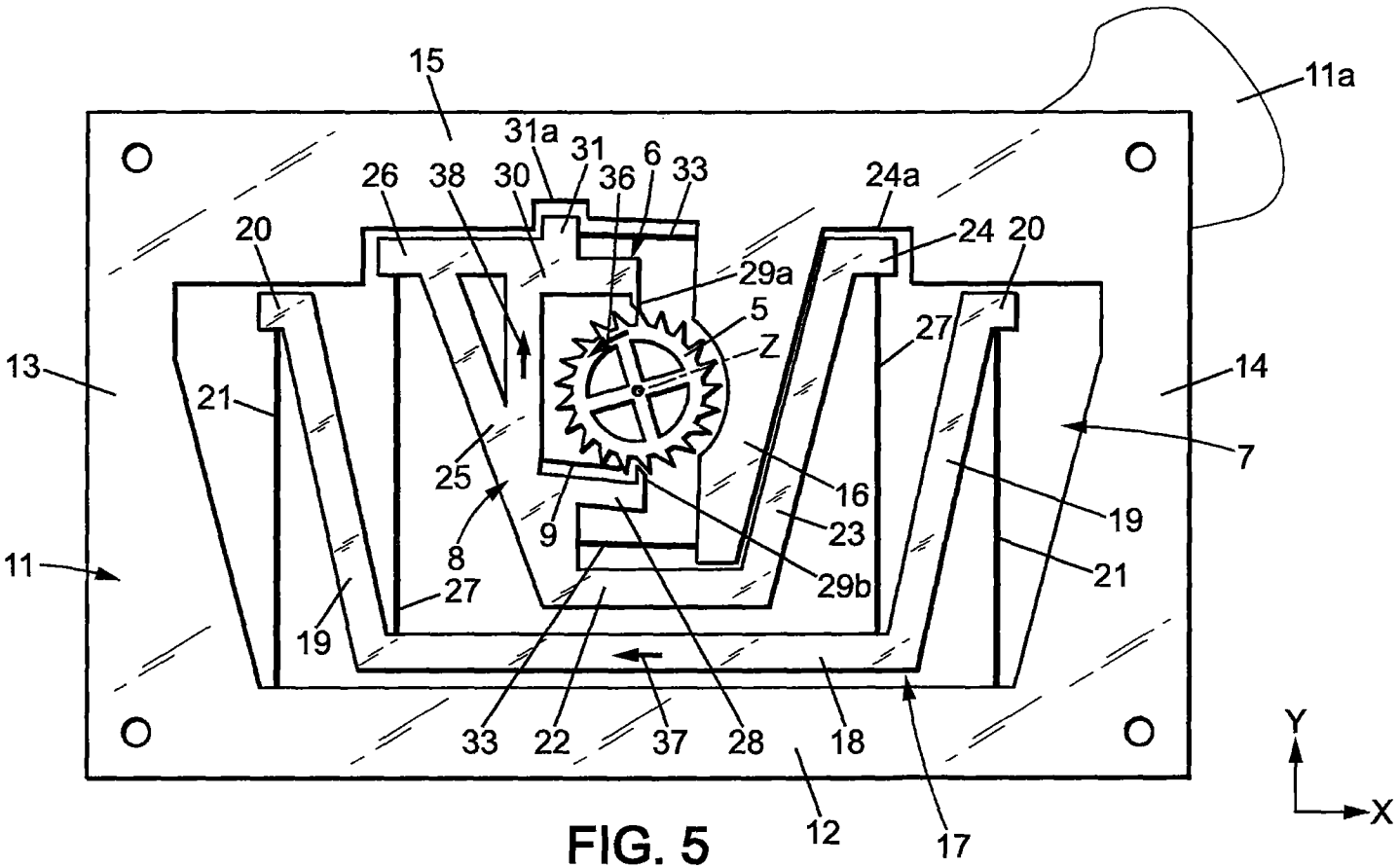
Figure 5A:
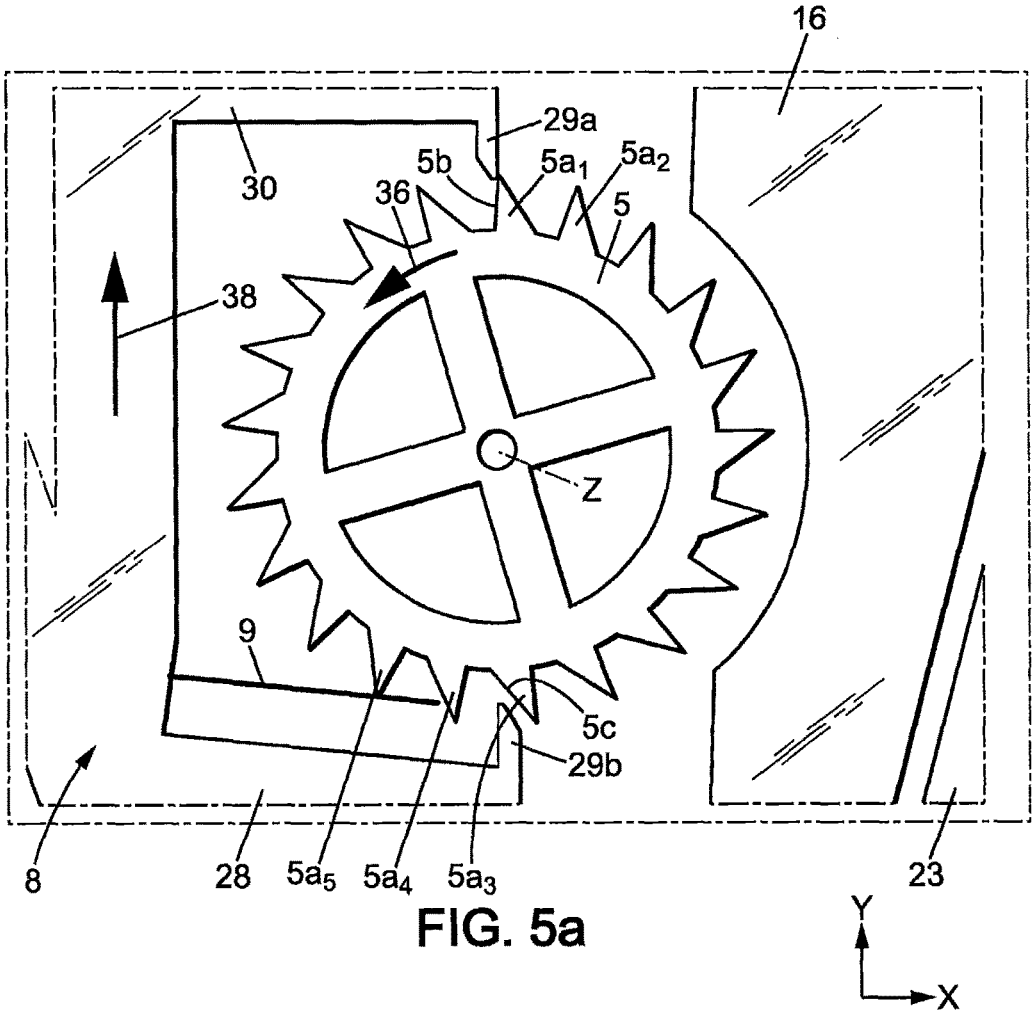

The regulating member 17 and blocking member 8 then change their direction of movement, and the mechanism arrives in the position of FIGS. 5, 5*a*, where:

regulating member 17 moves toward side 13 in the direction of arrow 37, and arrives close to neutral position;

blocking member 8 moves toward side 15 in the direction of arrow 38 and arrives in the first escape position where energy distribution wheel 5 will be released by the first stop member 29*a* and turn of one angular step in the direction of arrow 36;

second stop member 29*b* is already between two teeth $\mathbf{5}a_3$, $\mathbf{5}a_4$ of the energy distribution wheel 5, close to the rear face 5*c* of one of these teeth 5*a;* flexible tongue 9 is beginning to be flexed by tooth $\mathbf{5}a_5$ of the energy distribution wheel 5.

Figure 6:
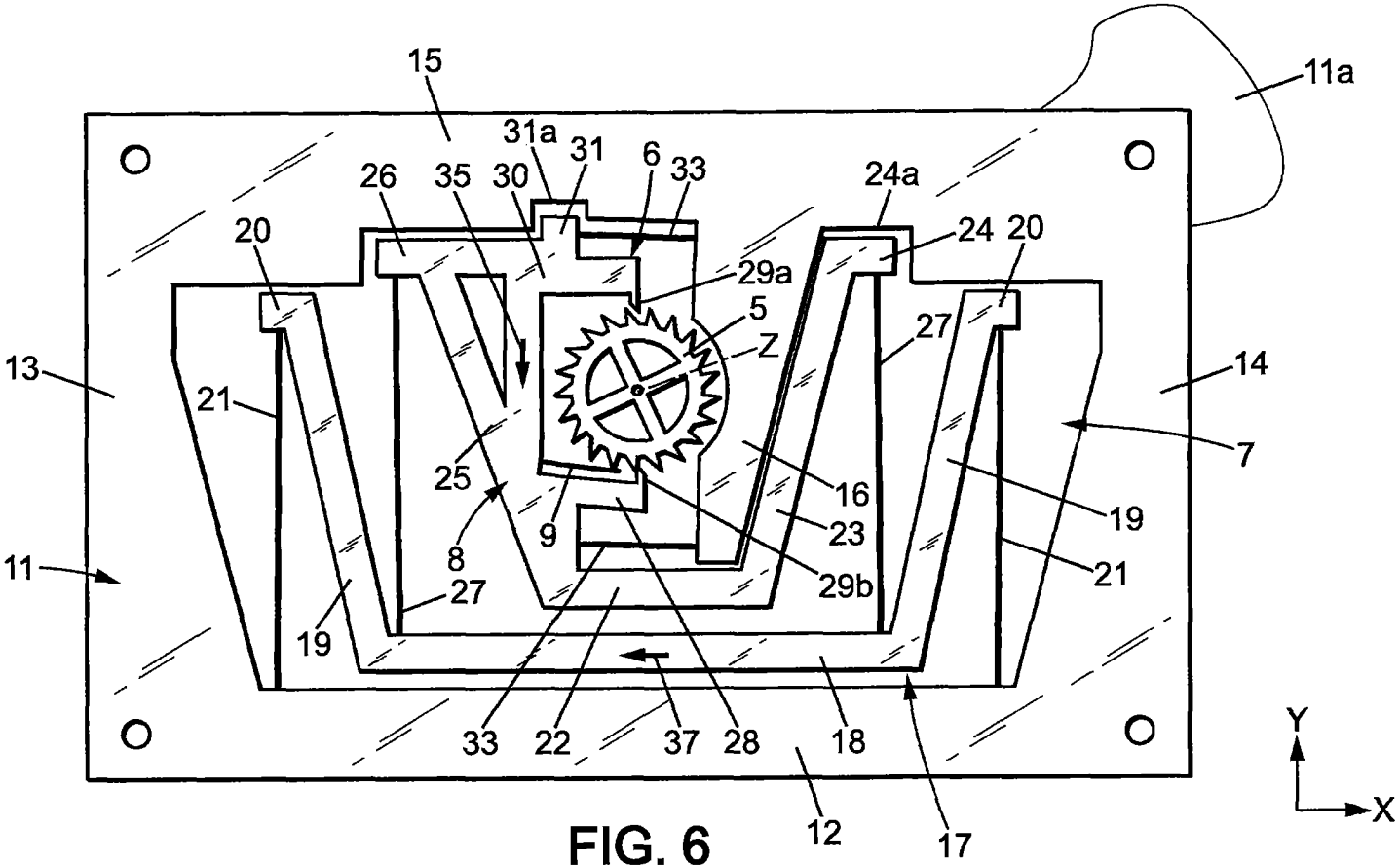
Figure 6A:
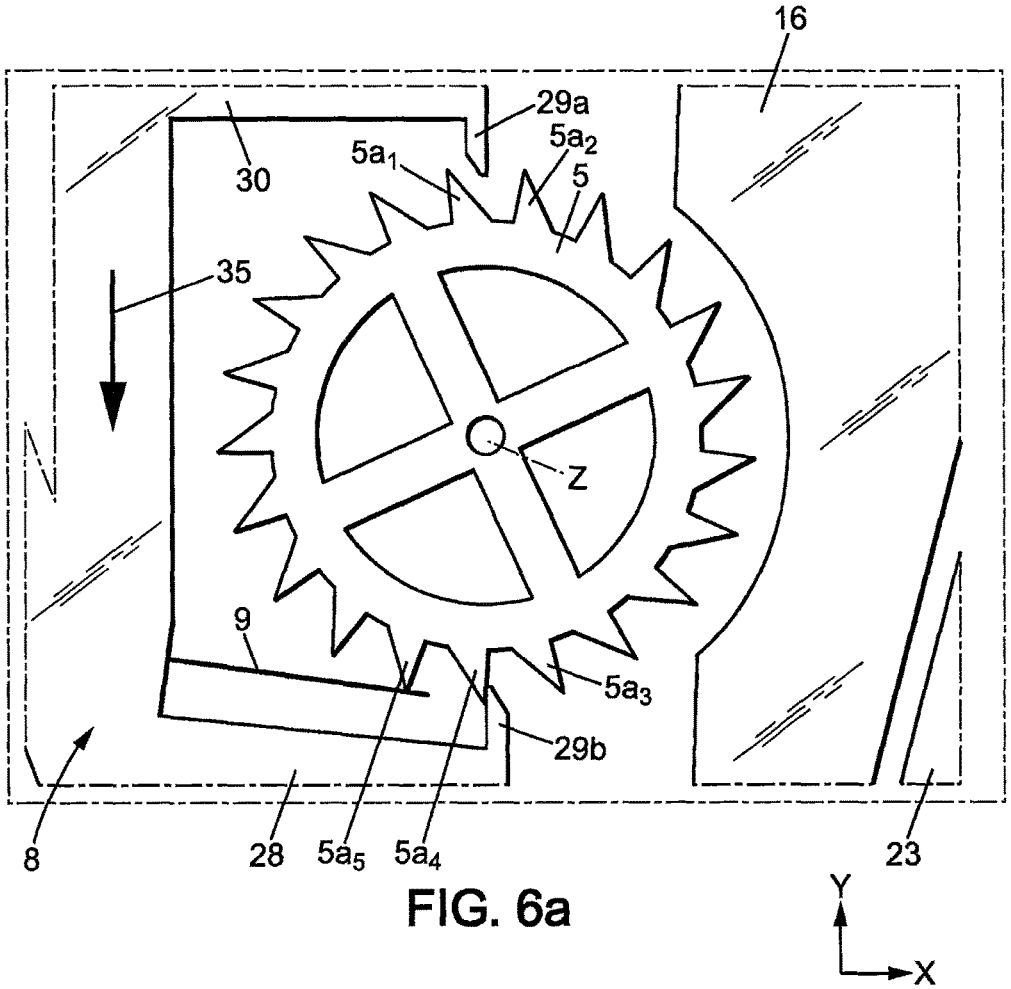

The energy distribution wheel 5 then quickly turns of one angular step and the mechanism arrives in the position of FIGS. 6, 6*a*, where:

regulating member 17 still moves toward side 13 in the direction of arrow 37, and is still close to neutral position;

blocking member 8 is close to the second blocking member and already moves toward side 12 in the direction of arrow 35;

first stop member 29*a* does not interfere with the energy distribution wheel 5 and is situated angularly between teeth $\mathbf{5}a_1$ and $\mathbf{5}a_2$;

second stop member 29*b* holds the energy distribution wheel 5 by abutment with the front face of tooth $\mathbf{5}a_4$;

flexible tongue 9 is in the second geometrical configuration, flexed at the maximum by tooth $\mathbf{5}a_5$, and is starting to progressively return to the first geometrical configuration, while releasing its energy to the blocking member 8 and the regulating member 17.

Figure 7:
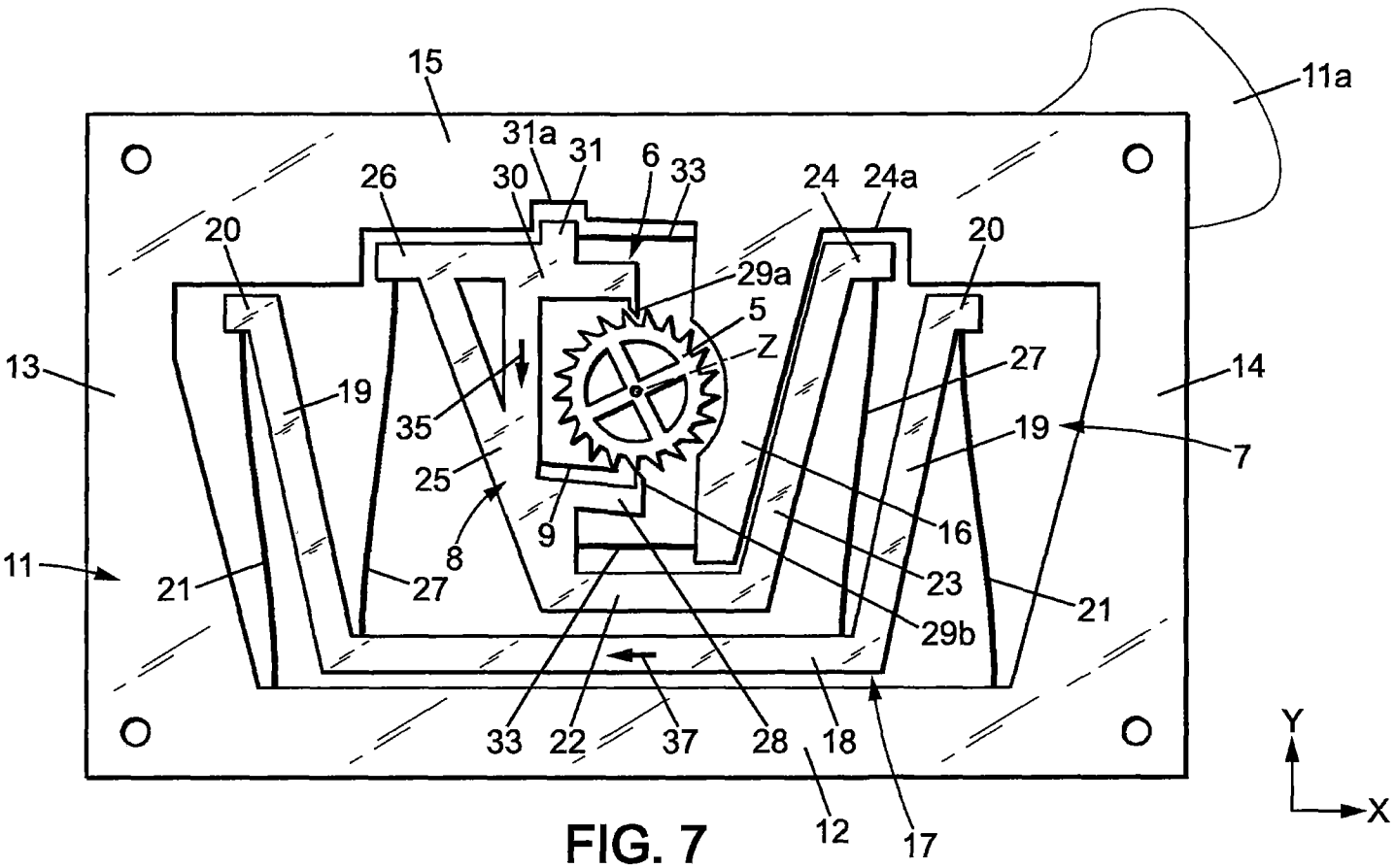
Figure 7A:
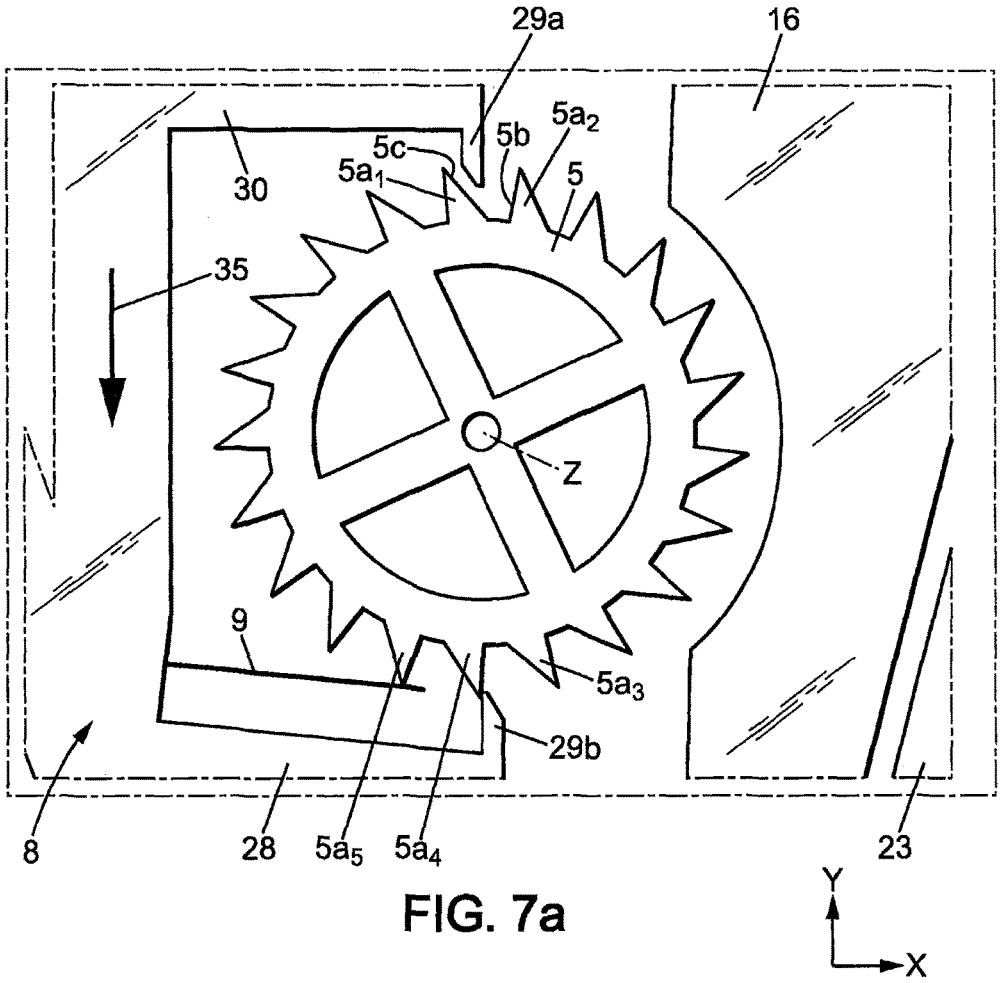

The mechanism then arrives in the position of FIGS. 7, 7*a*, where:

regulating member 17 still moves toward side 13 in the direction of arrow 37;

blocking member 8 still moves toward side 12 in the direction of arrow 35;

first stop member 29*a* is already between teeth 5*a*1 and $\mathbf{5}a_2$ of the energy distribution wheel 5, close to the rear face 5*c* of tooth $\mathbf{5}a_1$;

flexible tongue 9 has released its energy and has returned to the first (non-flexed) geometrical configuration.

Figure 8:
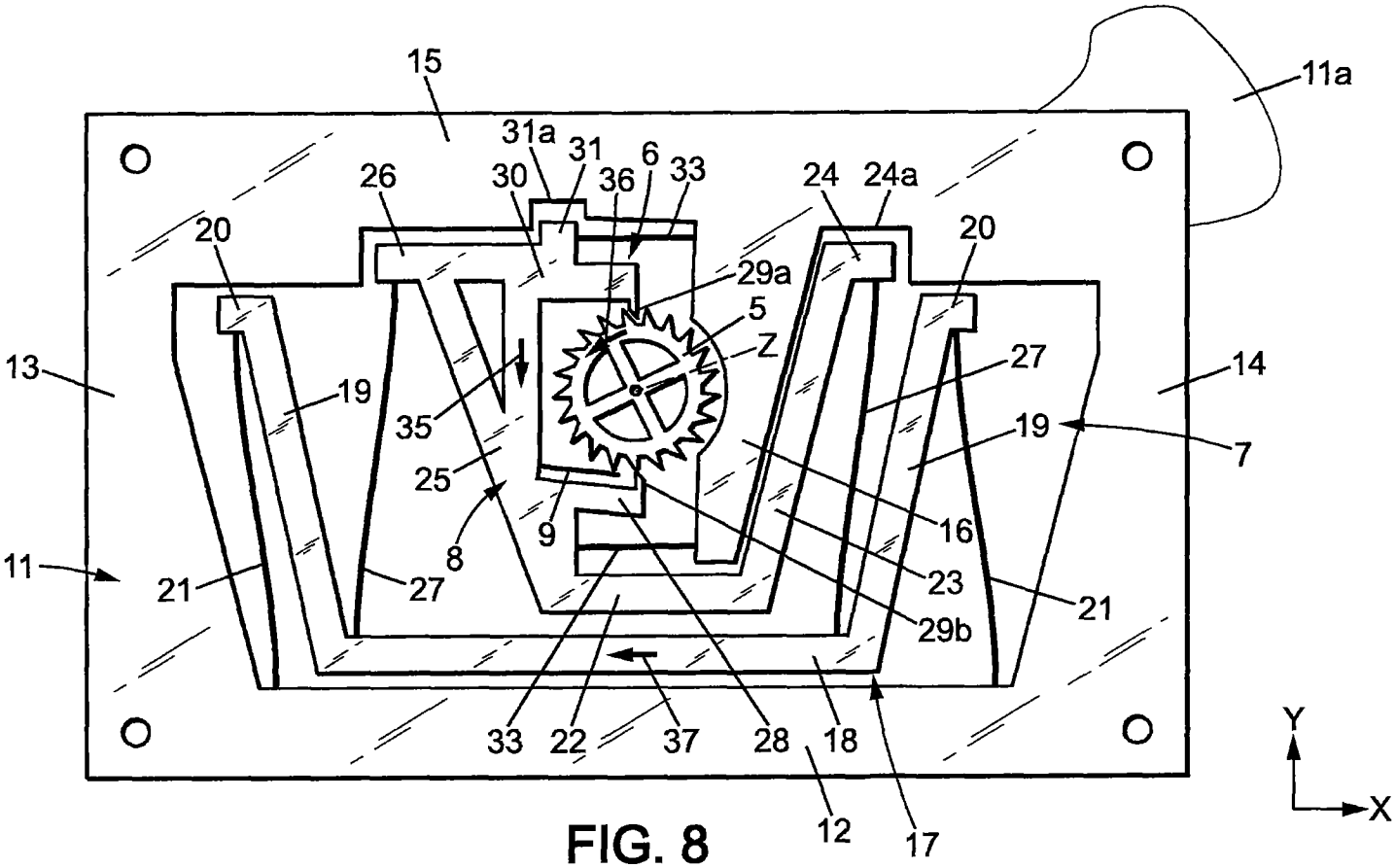
Figure 8A:
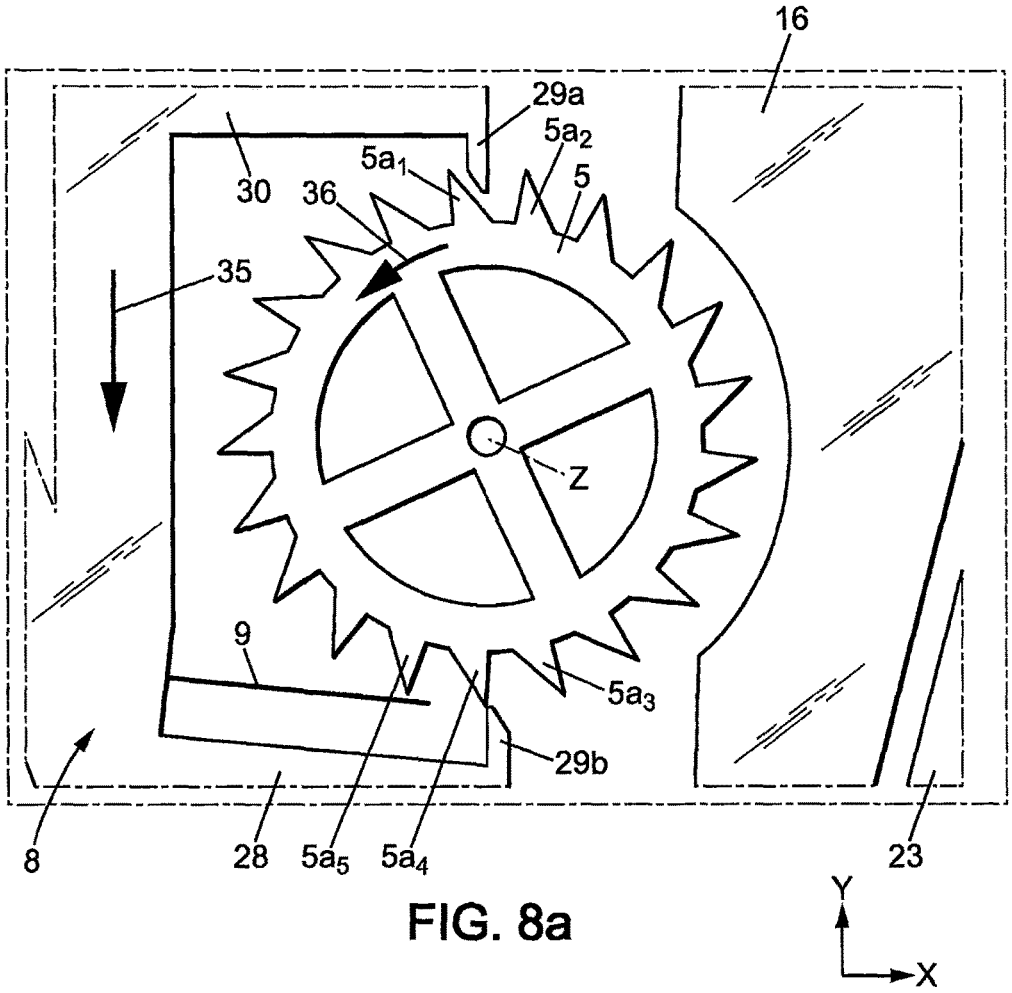

The mechanism then arrives in the position of FIGS. 8, 8*a*, where:

regulating member 17 still moves toward side 13 in the direction of arrow 37;

blocking member 8 still moves toward side 12 in the direction of arrow 35 and arrives in the second escape position where energy distribution wheel 5 will be released by the second stop member 29*b* and will turn of one angular step in the direction of arrow 36;

first stop member 29*a* is still between teeth 5*a*1 and $5a_2$ of the energy distribution wheel 5, close to the rear face 5*c* of tooth $5a_1$;

flexible tongue 9 is in the first (non-flexed) geometrical configuration.

Figure 9:
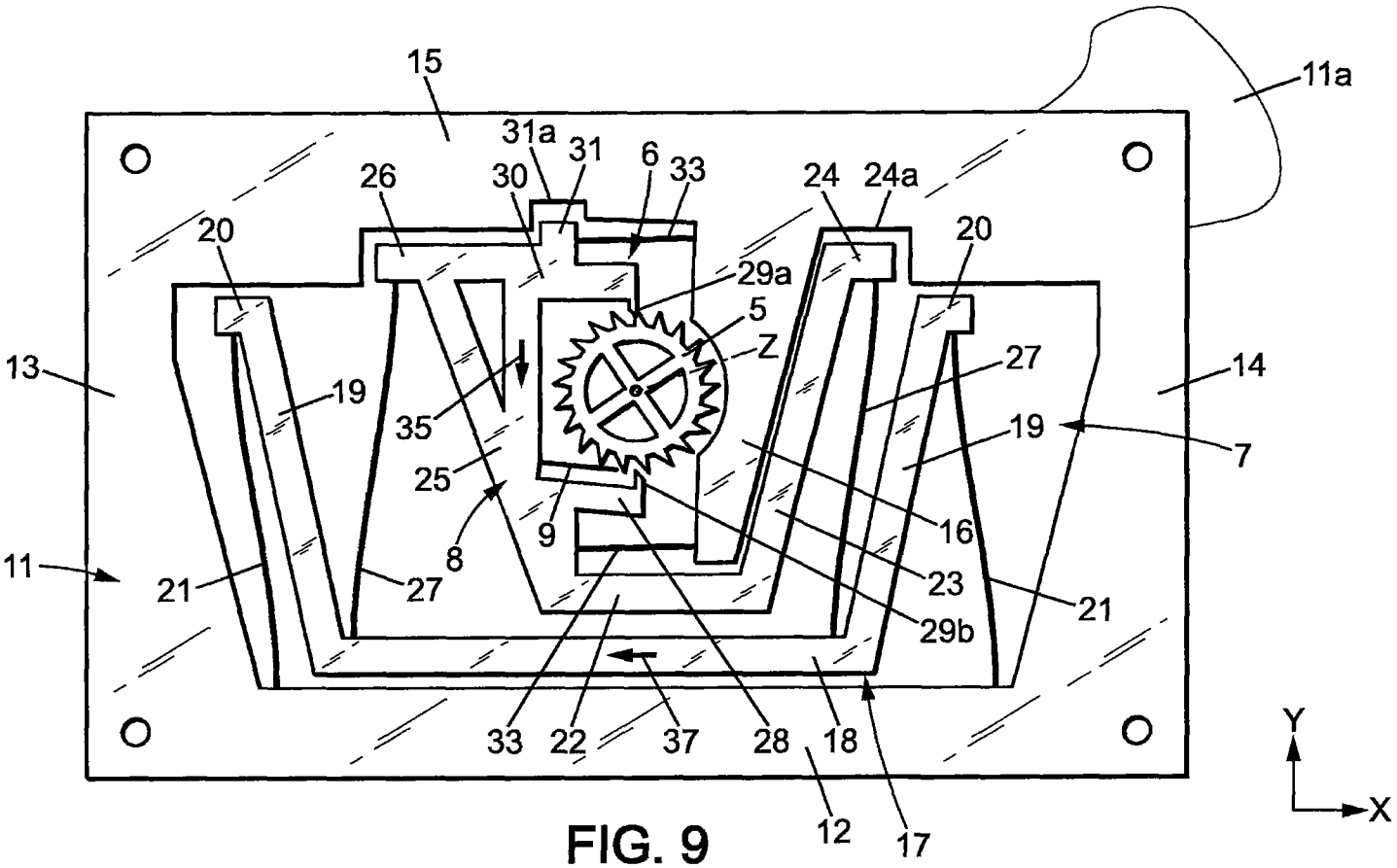
Figure 9A:
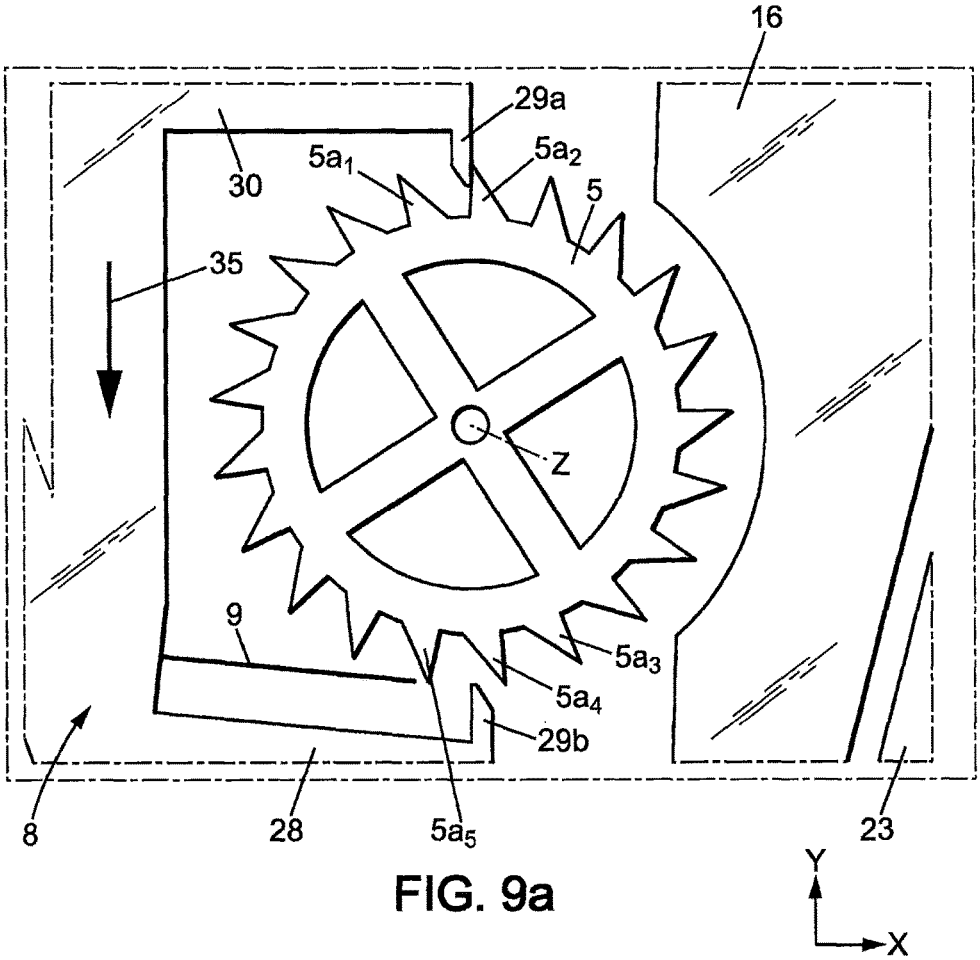

After the energy distribution wheel has turned of one angular step, the mechanism then arrives in the position of FIGS. 9, 9*a*, where:

regulating member 17 still moves toward side 13 in the direction of arrow 37, and is close to the first extreme regulating member position;

blocking member 8 still moves toward side 12 in the direction of arrow 35 and arrives close to the first extreme blocking member position;

energy distribution wheel 5 is held by the first stop member 29*a;* flexible tongue 9 is in the first (non-flexed) geometrical configuration.

The regulating member 17 and blocking member 8 then change direction and the same steps occur until the mechanism reaches back the position of FIGS. 3, 3*a*, and then the cycle is repeated.

Thus, the movement cycle of energy distribution wheel 5 includes two angular steps of rotation, each equivalent to half the angular extent of one tooth 5*a*. In the example of FIGS. 2-9, energy distribution wheel 5 has 21 teeth 5*a*, so that said angular step is $\alpha=360°/(21*2)=8.57°$. It should be noted that each movement cycle of energy distribution wheel 5 is completed during half an oscillation cycle of regulating member 17, so that the frequency of movements of energy distribution wheel 5 is 4 times the oscillation frequency of the regulator mechanism 7. Thus, if the frequency f of the regulator mechanism 7 is 30 Hz, then the frequency of the blocking member 8 will be $2f$=60 HZ and the frequency of movements of energy distribution wheel 5 will be $4f$=120 Hz.

The invention is not limited to translational movements of the regulating member 17 and blocking member 8; in particular, the first elastic suspension 21 may be arranged to impose either a translational movement, or a rotational movement to the regulating member 17, and the second elastic suspension 33 may be arranged to impose either a translational movement, or a rotational movement to the blocking member 8.

Figure 10:
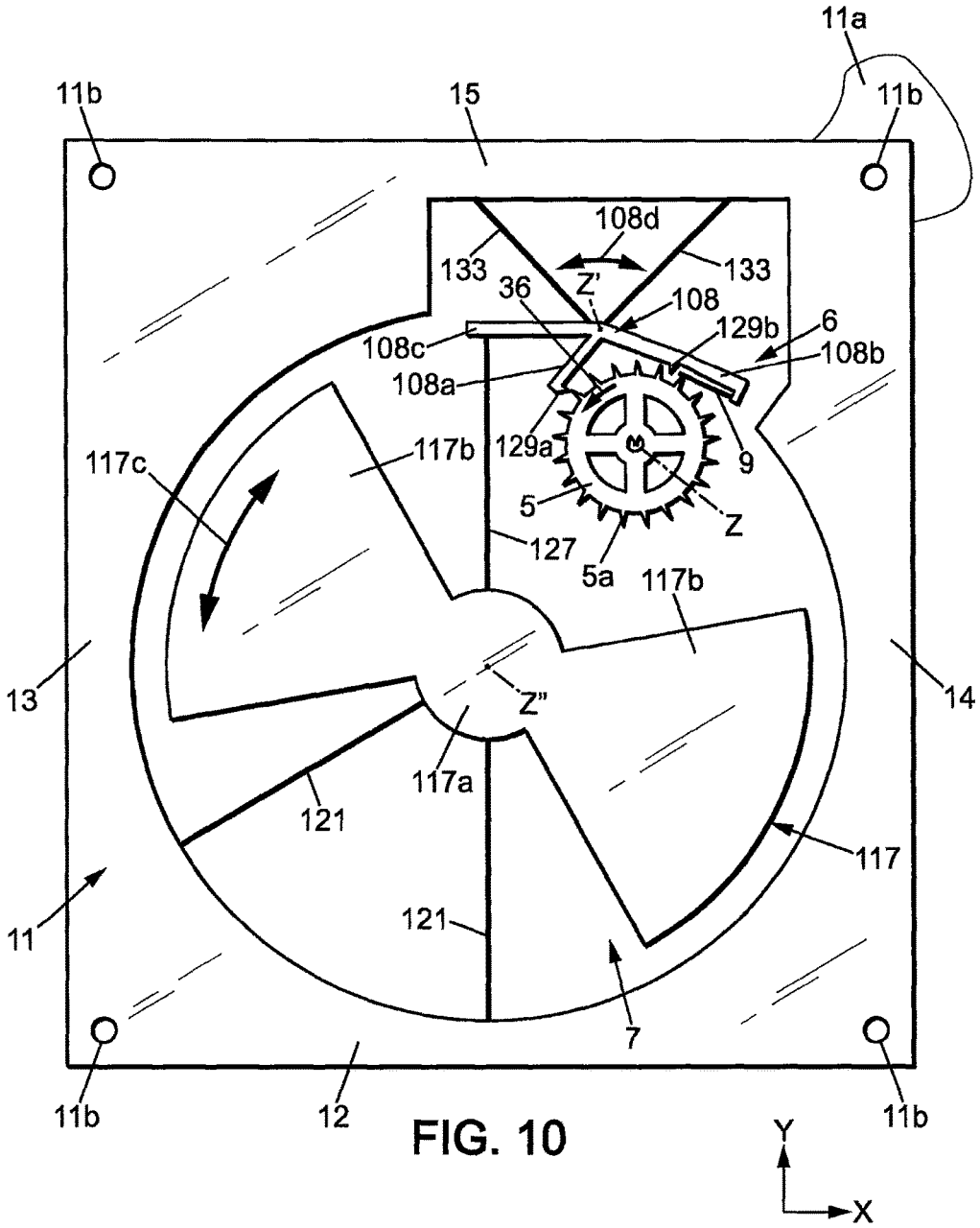
FIGS. 10-12 are views similar to FIG. 2, respectively for second, third and fourth embodiments of the invention.
Figure 11:
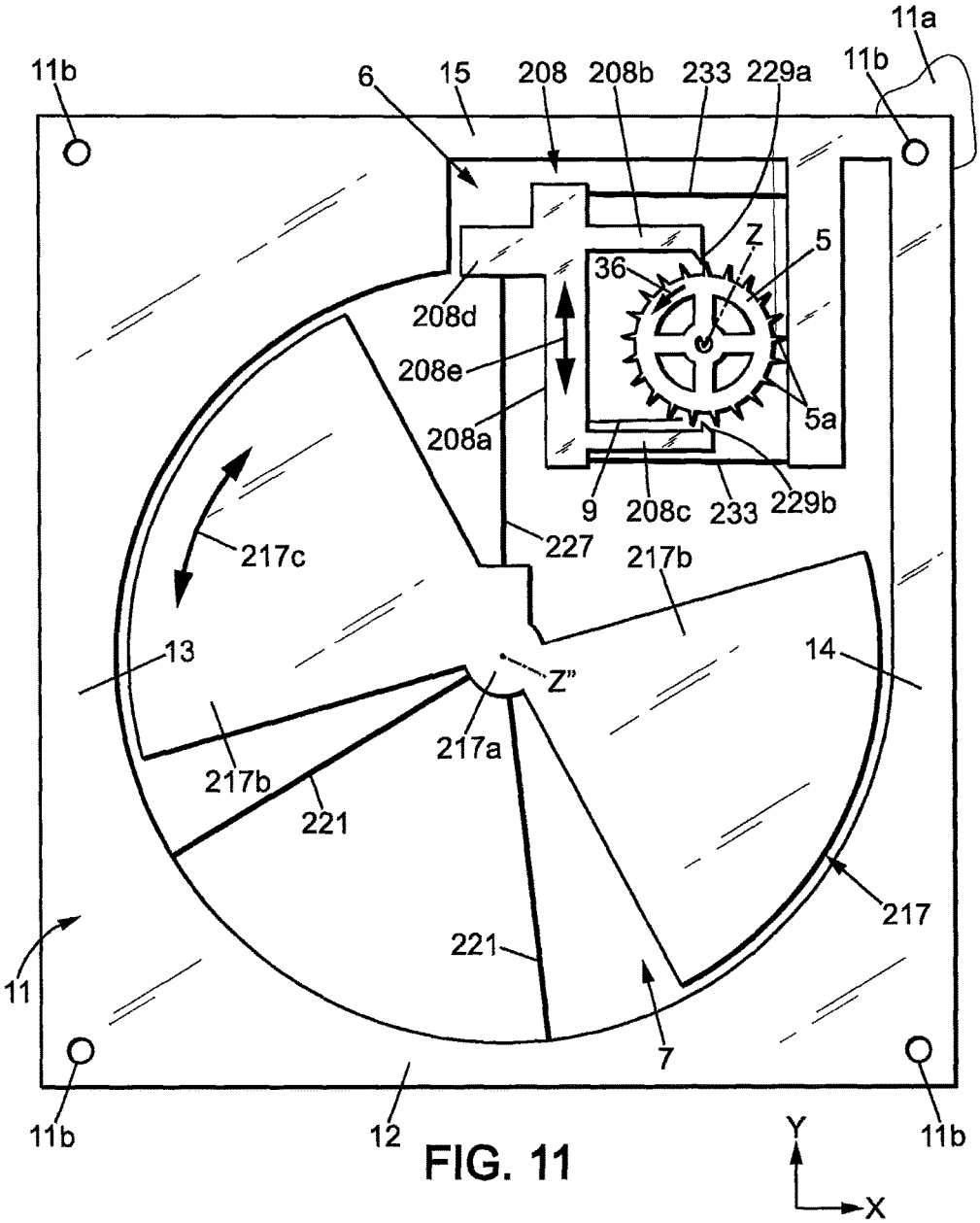
Figure 12:
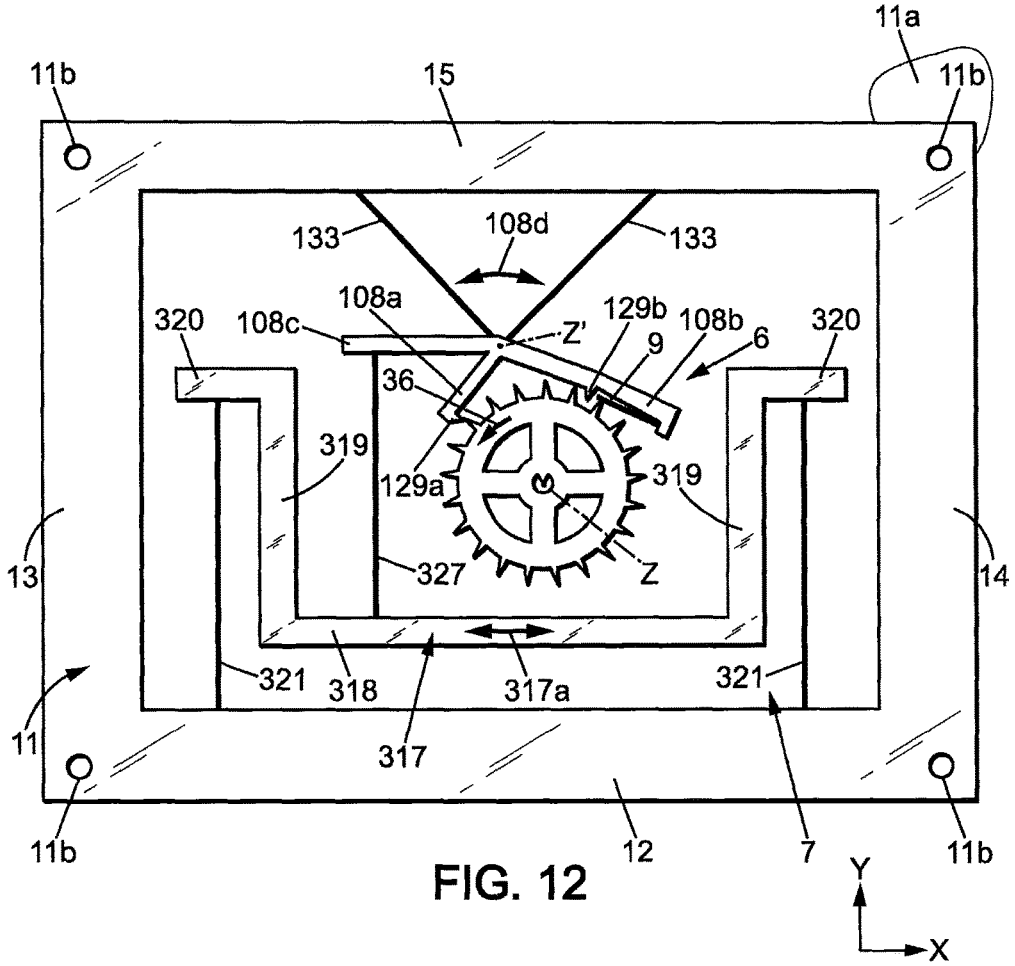

Three variants are shown in FIGS. 10-12 to illustrate these possibilities. These variants are similar to the embodiment of FIGS. 2-9 in their conception and operation, and will therefore not be described in detail here.

In the variant of FIG. 10, the regulator mechanism 7 has a rigid regulating member 117 which is pivotally mounted around an axis of rotation Z" parallel to the axis of rotation Z (axis Z" is not a fixed axis and may move under gravity, acceleration or shock), and the blocking mechanism 6 has a pivoting member 108 which is pivotally mounted around an axis of rotation Z' parallel to the axis of rotation Z (axis Z" is not a fixed axis and may move under gravity, acceleration or shock).

Regulating member 117 may have a central hub 117 connected to the frame of the plate 11 by the first suspension 121. First suspension 121 may have two elastic branches 121 disposed radially relative to the axis of rotation Z".

Regulating member 117 may also have a plurality of rigid arms 117*b* extending radially from the hub 117*a*, for instance two arms 117*b*.

The blocking member may have first and second arms 108*a*, 108*b* forming an angle together, each having a stop member 129*a*, 129*b* adapted to interfere with the energy distribution wheel 5. The axis of rotation Z' may be at the apex between arms 108*a*, 108*b*. The arm 108*b* may support the monostable elastic member 9, for instance an elastic tongue 9 extending from the free end of the arm 108*b* up to a free end close to the stop member 129*b*.

The blocking member 108 is connected to the frame of the plate 11 by a second suspension 133, for instance by two elastic branches 133 disposed radially with regard to the axis of rotation Z'.

The blocking member 108 may have a third rigid arm 108*c*, disposed radially with respect to the axis of rotation Z' and connected to the hub 117*a* of the regulating member by an elastic link 127.

When regulating member 117 oscillates around axis Z" in the direction of double arrow 117*c*, the elastic link 127 controls oscillation of blocking member 108 around axis Z' according to the double arrow 108*d*, so that stop members 129*a*, 129*b* alternately hold and release energy distribution wheel 5. During each rotation of energy distribution wheel 5, one of the teeth 5*a* of the energy distribution wheel 5 flexes the elastic tongue 9, which then releases its mechanical energy to the blocking member 108 and the regulating member 117.

The variant of FIG. 10 operates similarly to the embodiment of FIGS. 2-9.

In the variant of FIG. 11, the regulator mechanism 7 is similar to the variant of FIG. 10 and has a rigid regulating member 217 which is pivotally mounted around axis of rotation Z" parallel to the axis of rotation Z, while the blocking mechanism 6 has a pivoting member 208 which is movable in translation parallel to the second direction Y as in the embodiment f FIGS. 1-9.

Regulating member 217 may have a central hub 217 connected to the frame of the plate 11 by the first suspension 221. First suspension 221 may have two elastic branches 221 disposed radially relative to the axis of rotation Z".

Regulating member 217 may also have a plurality of rigid arms 217*b* extending radially from the hub 217*a*, for instance two arms 217*b*.

The blocking member 208 may have a rigid body 208*a* extending longitudinally in the second direction Y and two transversal arms 208*b*, 208*c* extending from the body 208*a* parallel to the first direction X on both sides of energy distribution wheel 5, each transversal arm having a stop member 229*a*, 2209*b* adapted to hold and release the energy distribution wheel 5 as in the embodiment of FIGS. 1-9.

The body 208*a* of the blocking member may be connected to the frame of the plate 11 by a second suspension 233, comprising for instance two second elastic branches 233 parallel to the first direction X.

The blocking member 208 also includes an elastic tongue 9, extending from the body 208*a* substantially parallel to the first direction X, up to a free end close to stop member 229*b*.

The blocking member 208 may further include an additional arm 208*d*, extending opposite the transversal arms from the body 208*a* and connected to the hub 217*a* of the regulating member by an elastic link 227.

When regulating member 217 oscillates around axis Z" in the direction of double arrow 217*c*, the elastic link 227 controls oscillation of blocking member 208 in the second direction Y according to the double arrow 208*e*, so that stop members 229*a*, 229*b* alternately hold and release energy distribution wheel 5. During each rotation of energy distribution wheel 5, one of the teeth 5*a* of the energy distribution wheel 5 flexes the elastic tongue 9, which then releases its mechanical energy to the blocking member 208 and the regulating member 217.

The variant of FIG. 11 operates similarly to the embodiment of FIGS. 2-9.

In the variant of FIG. 12, the regulator mechanism 7 is similar to that of FIGS. 2-9 and has a rigid regulating member 317 which movable in translation parallel to the first direction X, while the blocking mechanism 6 is that of FIG. 10.

Regulating member 317 may have main body 318, two lateral arms 319 and free ends 320 which are similar to parts 18, 19, 20 of the embodiment of FIGS. 2-9 and may be connected to the frame of plate 11 by two first elastic branches 321 parallel to the second direction Y, as in the embodiment of FIGS. 2-9. The main body 318 may be connected to the arm 108*c* of blocking member 8 by an elastic link 327.

When regulating member 317 oscillates in the direction of arrows 217*a*, the elastic link 327 controls oscillation of blocking member 108 around axis Z' according to the double arrow 108*d*, so that stop members 129*a*, 129*b* alternately hold and release energy distribution wheel 5. During each rotation of energy distribution wheel 5, one of the teeth 5*a* of the energy distribution wheel 5 flexes the elastic tongue 9, which then releases its mechanical energy to the blocking member 108 and the regulating member 117.

The variant of FIG. 12 operates similarly to the embodiment of FIGS. 2-9.

The fifth embodiment of the invention, shown in FIGS. 13-20, is similar to the first embodiment of FIGS. 2-9 in its structure and operation. Mainly the differences of the fifth embodiment over the first embodiment will now be described in details; the remaining description of the first embodiment still applies to the fifth embodiment.

In this fifth embodiment as shown in the drawings, plate 11 still forms a frame which may have for example two substantially parallel sides 12, 15 extending in a first direction X and two substantially parallel sides 13, 14 extending in the second direction Y, as in the first embodiment.

The blocking member 8 may still be mounted on the frame of the plate 11 by said second elastic suspension 33. The second elastic suspension may here comprise one flexible, second elastic branch 33 extending substantially parallel to the first direction X, so that blocking member 8 is movable in translation substantially parallel to the second direction Y, in direction of double arrows 8*a*. The blocking member is thus movable in two opposite directions from a neutral position, between two extreme positions called here "first and second extreme blocking member positions". The elastic branches 33 may be arranged so as to be substantially rectilinear (not flexed) when the blocking member 8 is at rest in the neutral position.

Figure 13:
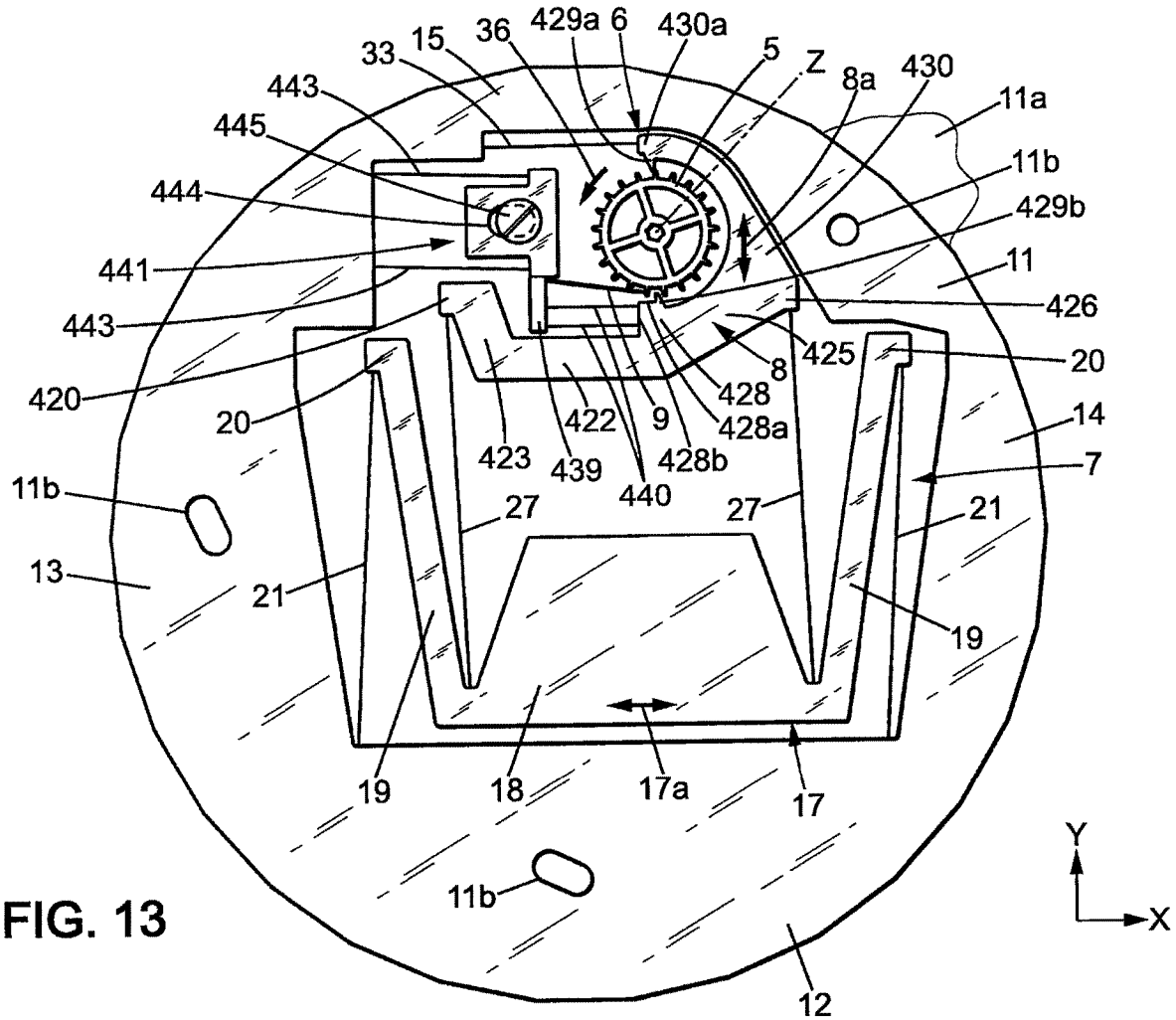
FIGS. 13, 13*a*-20, 20*a* are views similar to FIGS. 2, 2*a*-9, 9*a*, in a fifth embodiment of the invention.
Figure 13A:
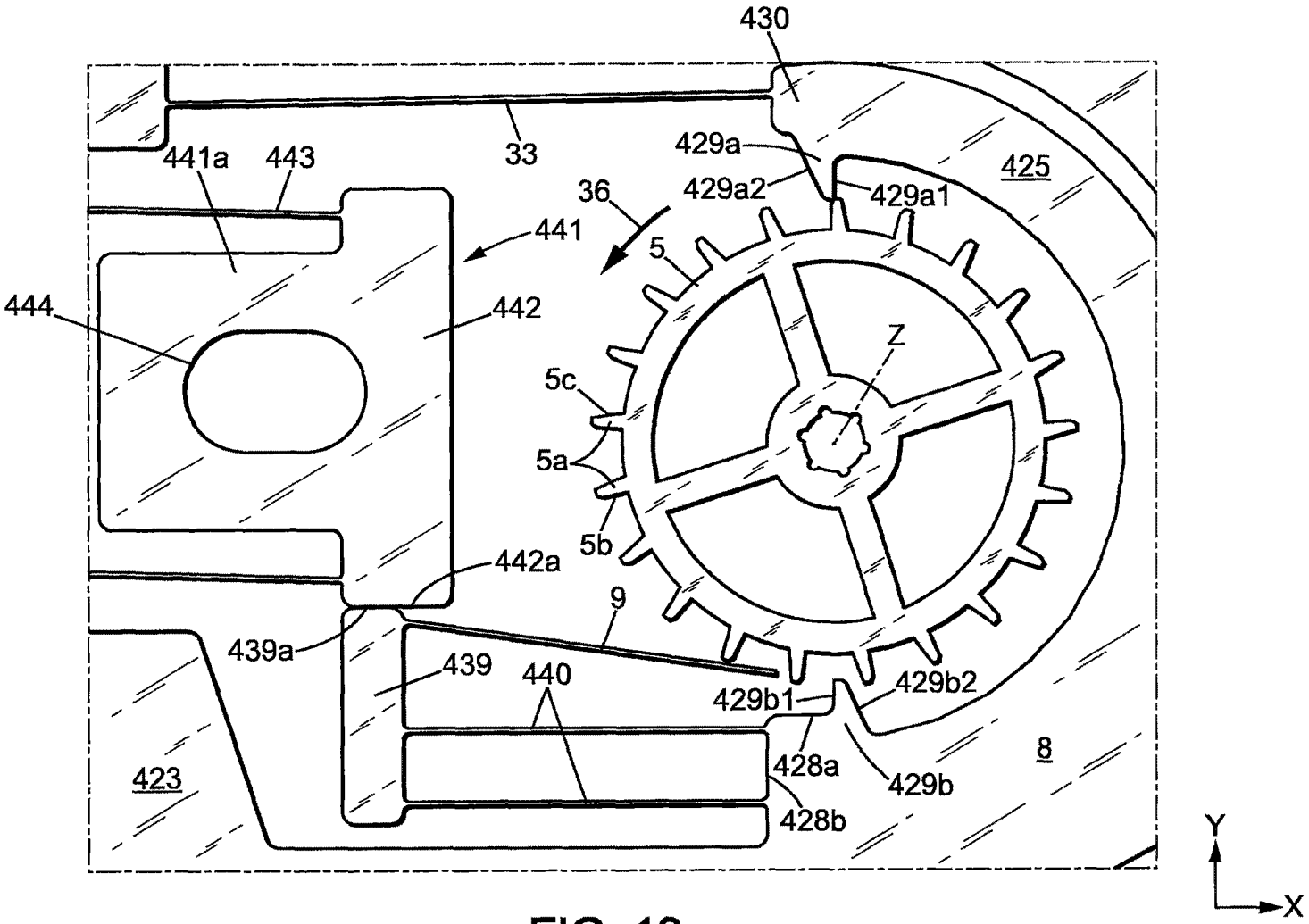

In the example shown on FIGS. 13, 13*a* the blocking member 8 may include:

- a rigid base 422 close to the main body 18 of regulating member 17 and extending longitudinally in the first direction X, and
- two diverging rigid lateral arms 423, 425 extending from the ends of the base 422 toward the side 15 of plate 11, up to respective free ends 424, 426. The free ends 424, 426 may extend outwardly opposite to each other, substantially parallel to the first direction X.

The elastic links 27 may have first ends connected to main body 18 of regulating member 17, close to the ends thereof, and second ends respectively connected to the free ends 424, 426 of the arms 423, 425.

Besides, the free end 426 of the lateral arm 425 may be extended by a rigid arm 430. The rigid arm 430 extends partly around energy distribution wheel 5, away from the base 422 in the second direction Y and then toward the other lateral arm 423 in the first direction X, up to a free end 430*a*.

The base 422 may also have a rigid portion 428, for instance extending toward the energy distribution wheel 5.

The energy distribution wheel 5 is between the free end 430*a* of rigid arm 430 and the free end 428*a* of rigid part 428.

The respective free ends 430*a*, 428*a* may have respectively first and second stop members 429*a*, 429*b*. First and second stop members 429*a*, 429*b* may be in the form of rigid fingers protruding toward each other from the free ends 430*a*, 428, in the second direction Y.

First and second stop members 429*a*, 429*b* are designed to cooperate with the teeth 5*a* of the energy distribution wheel 5, as already described in the first embodiment, to alternately hold and release said energy distribution wheel 5. First and second stop members 429*a*, 429*b* may have a stop face, respectively 429*a*1, 429*b*1, facing the front face 5*b* of the teeth, and an opposite rear face, respectively 429*a*2, 429*b*2. The stop faces 429*a*1, 429*b*1 may preferably be disposed in a radial plane parallel to axis Z, while the rear faces 29*a*2, 29*b*2 may extend slantwise so that the stop members 429*a*, 429*b* have pointed shapes.

The blocking member 8 may be connected to the monostable elastic member 9, through a decoupled support 439. Decoupled support 439 is a rigid member which is elastically mounted on blocking member 8 in order to be movable relative to blocking member 8 in the second direction Y. More particularly, decoupled support 439 may be mounted on blocking member 8 trough at least one elastic, flexible link 440, for instance two flexible links 440, extending in the first direction X between decoupled support 439 and a lateral face 428*b* of rigid part 428 facing decoupled support 439.

As in the first embodiment, monostable elastic member may be a flexible tongue 9 extending substantially parallel to the first direction X between a first end connected to the blocking member 8 (the first end is here rigid with decoupled member 439) and a second, free end which is close to the second stop member 29*b* and which is bearing on the teeth 5*a* of the energy distribution wheel 5.

Besides, the movements of decoupled support 439 relative to the plate 11 are limited by a stop 441 which is rigidly connected to plate 11.

In the particular example shown on FIGS. 13 and 13*a*, stop 441 may have a body 441*a* and an enlarge head 442 which may be larger than the body 441*a* in the second direction Y. The enlarged head 442 may have a stop face 442*a* facing a lateral face 439*a* of decoupled support 439 for limiting movements thereof.

In one embodiment, as shown in FIGS. 13 and 13*a*, stop 441 may be adjustable in position relative to plate 11. For instance, stop 441 may be fixed to support plate 11*a* by a screw going through a hole 444 of body 441*a*, said hole being of larger dimension than the stem of the screw. Stop 441 may further be connected to plate 11 by at least one flexible link 443, for instance two such flexible links 443 extending preferably parallel to the first direction X. Flexible links 443 have no effect during operation of the mechanism, the allow stop 441 to be in one piece with plate 11.

The operation of the mechanism is similar to the first embodiment, except that the first end of flexible tongue 9 has a predetermined, fixed position relative to plate 11 and relative to the axis of rotation Z of energy distribution wheel 5 while said flexible tongue 9 is elastically deformed by the teeth 5*a* of the energy distribution wheel 5 from said first geometrical configuration to said second geometrical configuration. This is due to the fact that the stop 441 is positioned to stop decoupled support 439 before said flexible tongue 9 comes into contact with a tooth 5*a* of the energy distribution wheel 5 during rotation of the energy distribution wheel 5 when the blocking member 8 is between the first escape position and the second extreme blocking member position. Thus, the flexible tongue 9 accumulates a very precise predetermined potential mechanical energy of elastic deformation, corresponding to the geometrical deformation thereof between the predetermined first geometrical configuration and the predetermined second geometrical configuration. The decoupled support 439 separates from stop 441 once the energy distribution wheel 5 has been stopped by the second stop member 429*b*.

This high precision of the amount of energy stored in the flexible tongue 9 and given back to the oscillator at each cycle, is obtained thanks to the decoupled support 439, which ensures that the first end of the flexible tongue is fixed during rotation of the energy distribution wheel 5, even when this rotation becomes slower (for instance when the main spring 2 has low energy). Without the decoupled support 439, when rotation of the energy distribution wheel 5 becomes slower, the flexible tongue 9 might go away from the energy distribution wheel before said flexible tongue has been deformed of the normal value.

The operation of the mechanism will now be described step by step, with regard to FIGS. 14, 14*a*-20, 20*a*.

Figure 14:
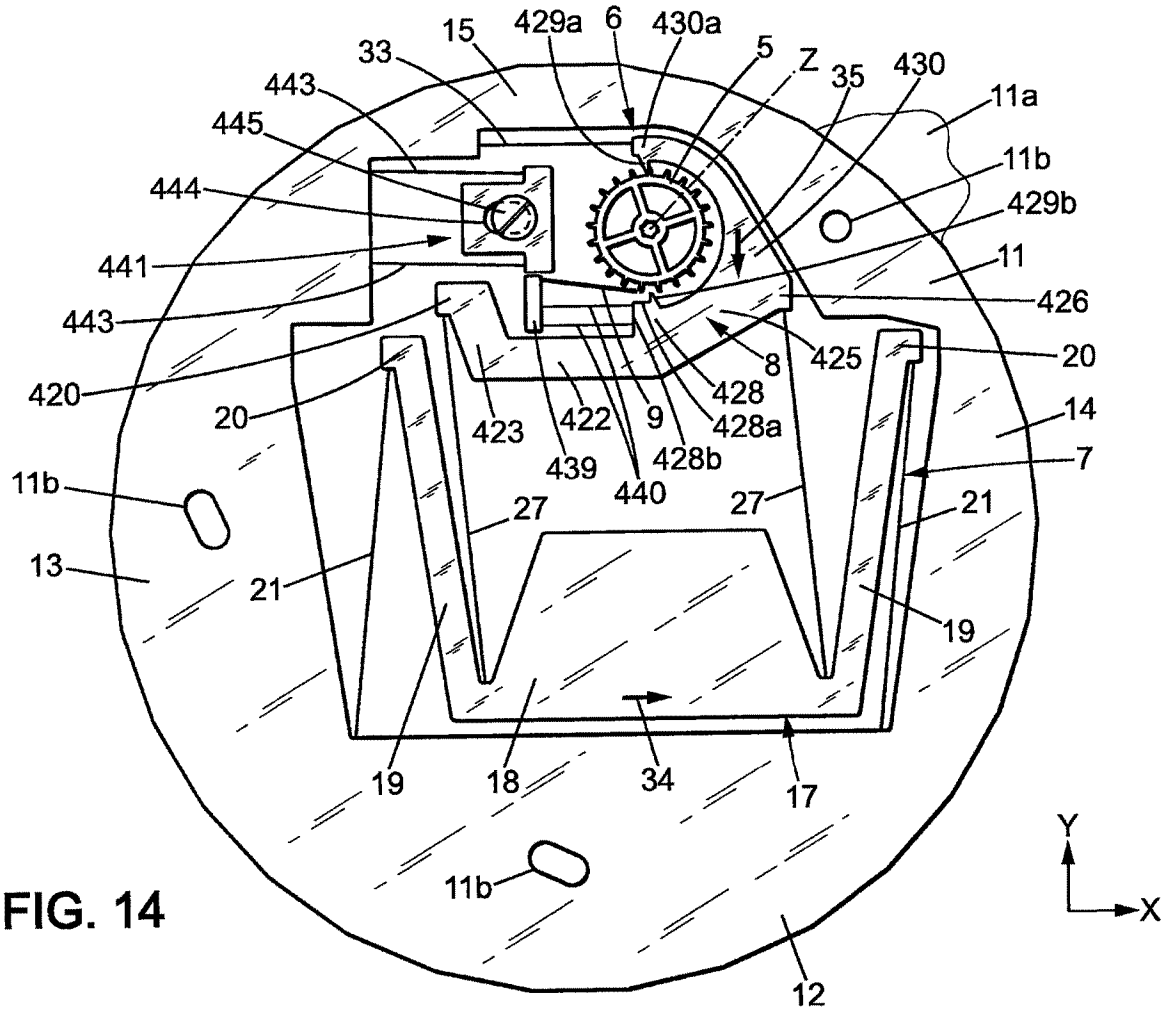
Figure 14A:
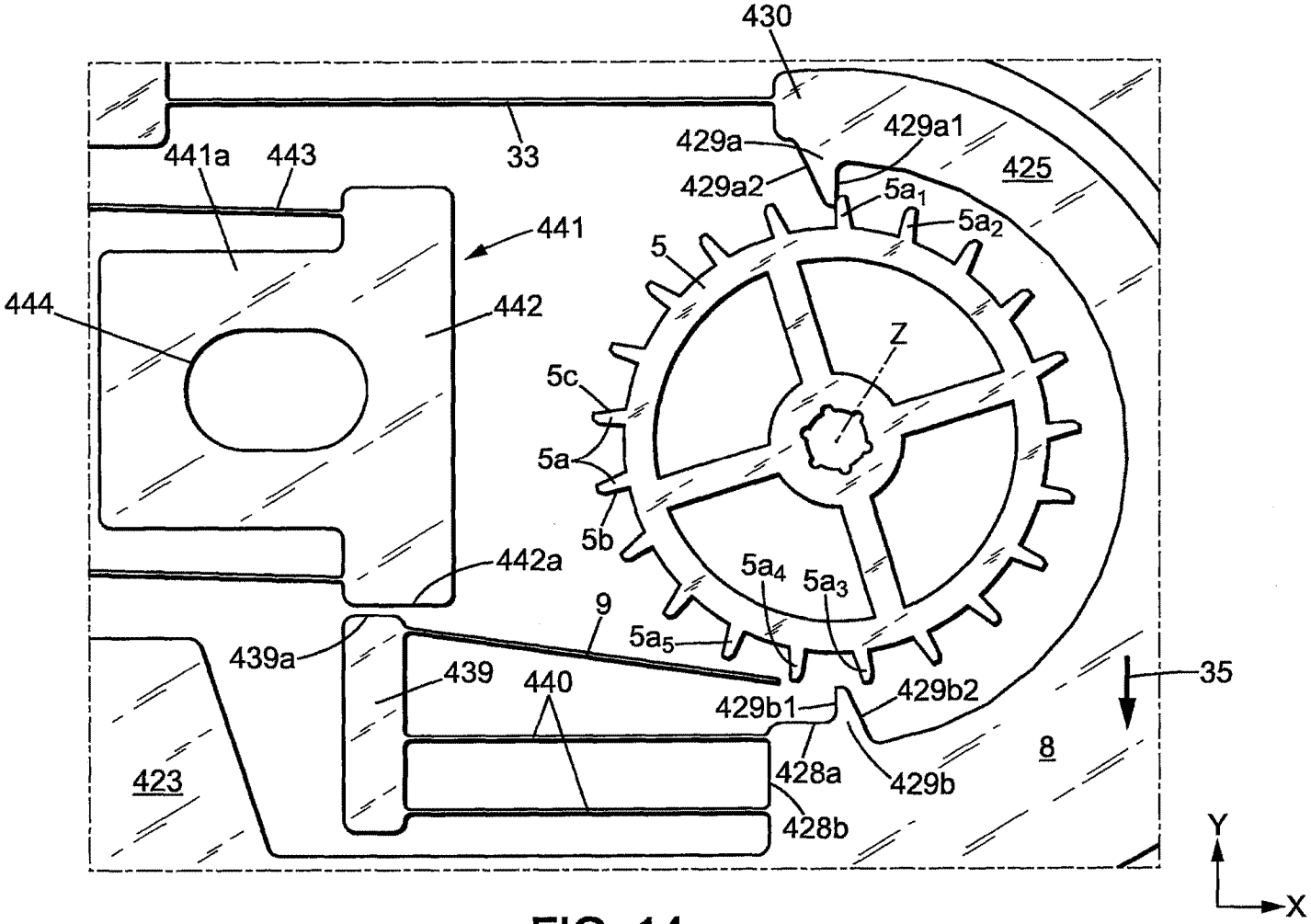

In the position of FIGS. 14 and 14*a:*

- regulating member 17 is moving toward side 14 in the direction of arrow 34 and is close to the second extreme regulating member position;
- blocking member 8 is moving toward side 12 in the direction of arrow 35 and is close to the first blocking member regulating member position, so that energy distribution wheel 5 is held by the first stop member 429*a;*
- second stop member 429*b* does not interfere with the energy distribution wheel 5;
- flexible tongue 9 is in the first geometric position (rest position);
- decoupled support 439 is not in contact with stop 441.

For a better understanding, reference numerals have been given to some of the teeth 5*a* on FIGS. 14*a*-20*a*. The situation of these teeth is as follows in the position of FIG. 14*a:*

- tooth $5a_1$ is the tooth which is held by the first stop member 429*a;*
- tooth $5a_2$ is the next tooth which will move toward the first stop member 429*a* in the direction of rotation at the next rotation step of the energy distribution wheel 5;
- teeth $5a_3$ and $5a_4$ are situated respectively past and before the second stop member 429*b* in the direction of rotation 36 of the energy distribution wheel 5;
- tooth $5a_4$ is the next tooth to move toward second stop member 429*b* after tooth $5a_4$ in the direction of rotation of the energy distribution wheel 5.

Figure 15:
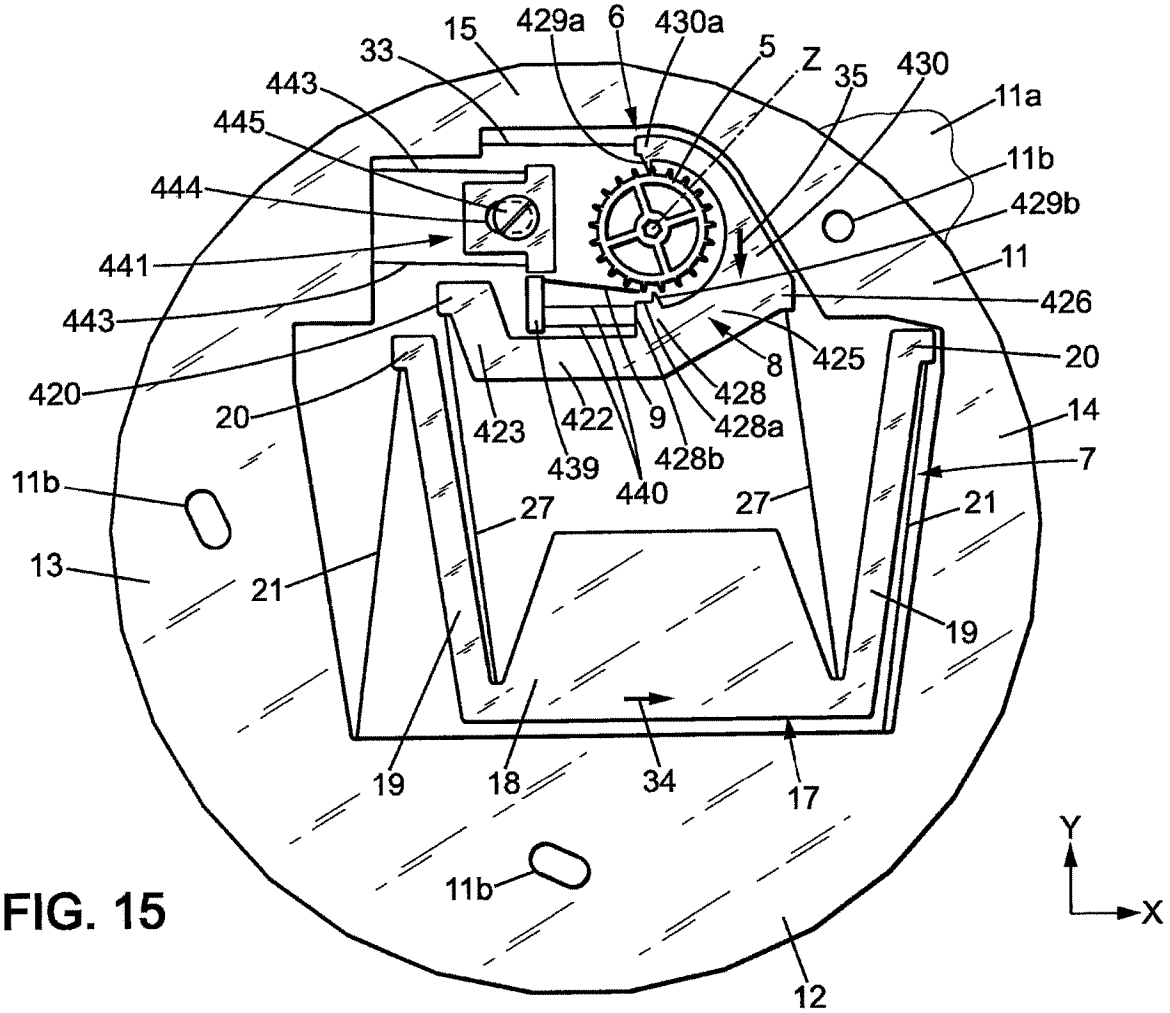
Figure 15A:
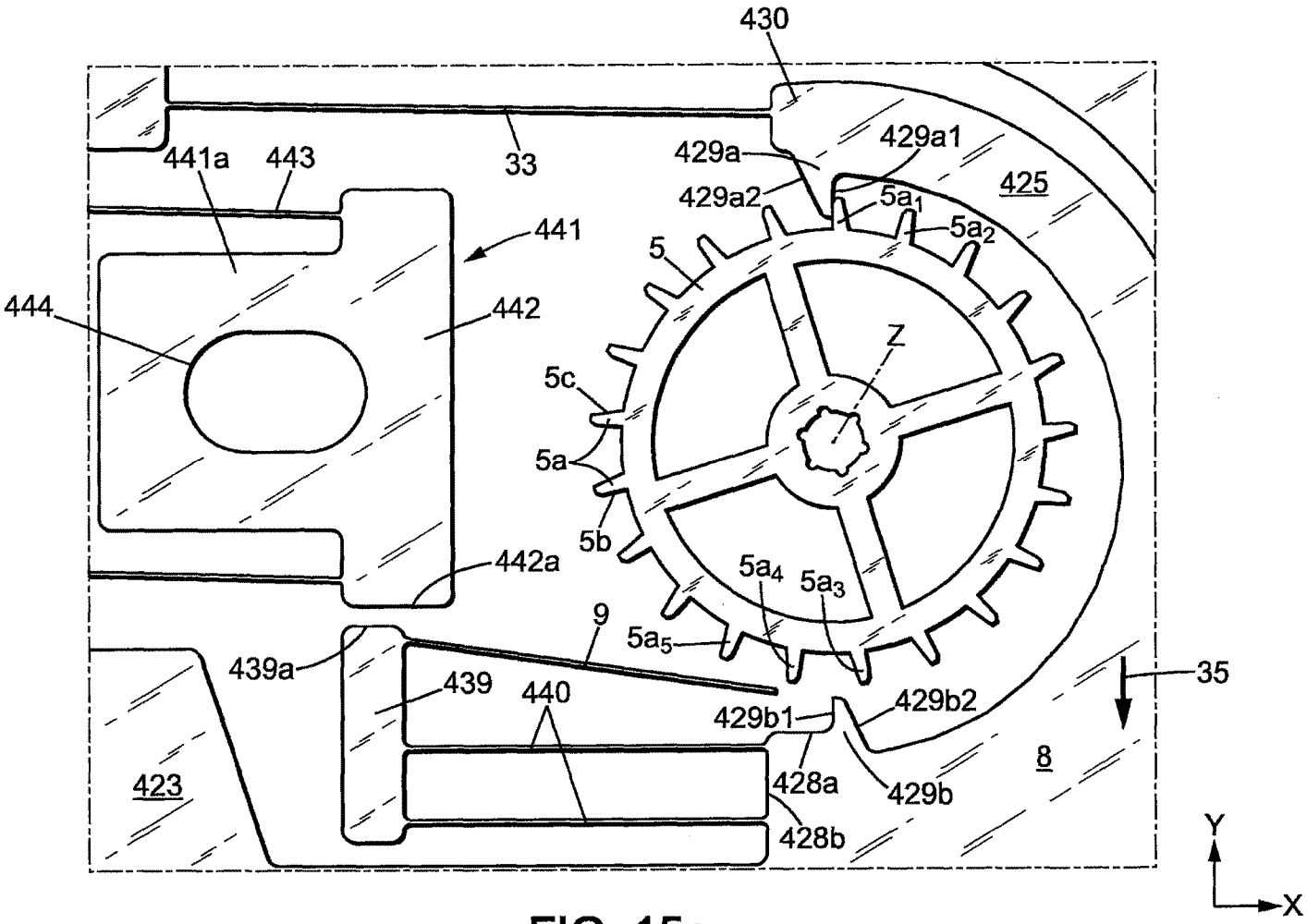

The mechanism then arrives in the position of FIGS. 15, 15*a*, where:

- regulating member 17 arrives in the second extreme regulating member position;
- blocking member 8 arrives in the first extreme blocking member position, and energy distribution wheel 5 is still held by the first stop member 429*a;*
- flexible tongue 9 is still in the first geometric position (rest position);
- decoupled support 439 is still not in contact with stop 441.

Figure 16:
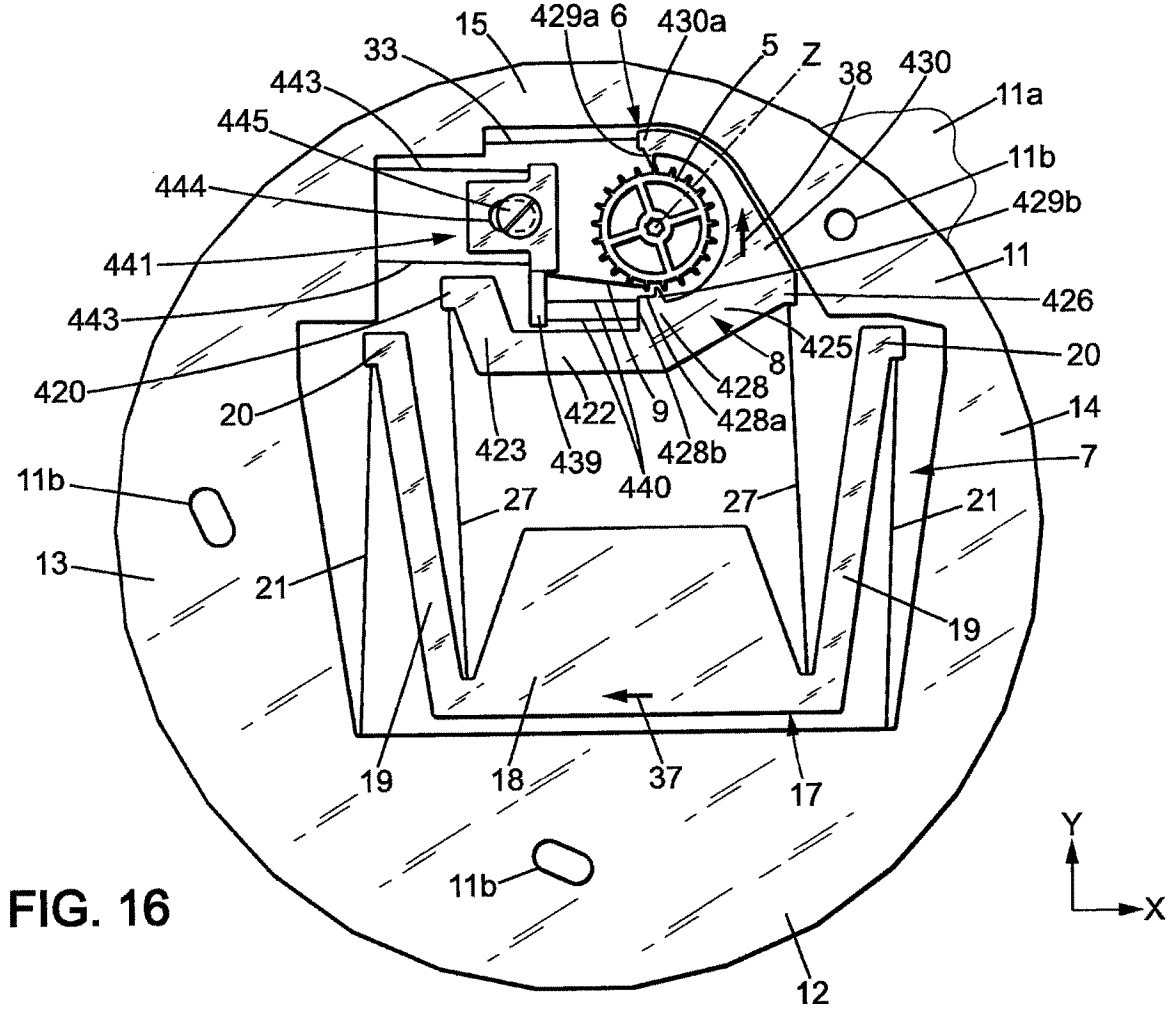
Figure 16A:
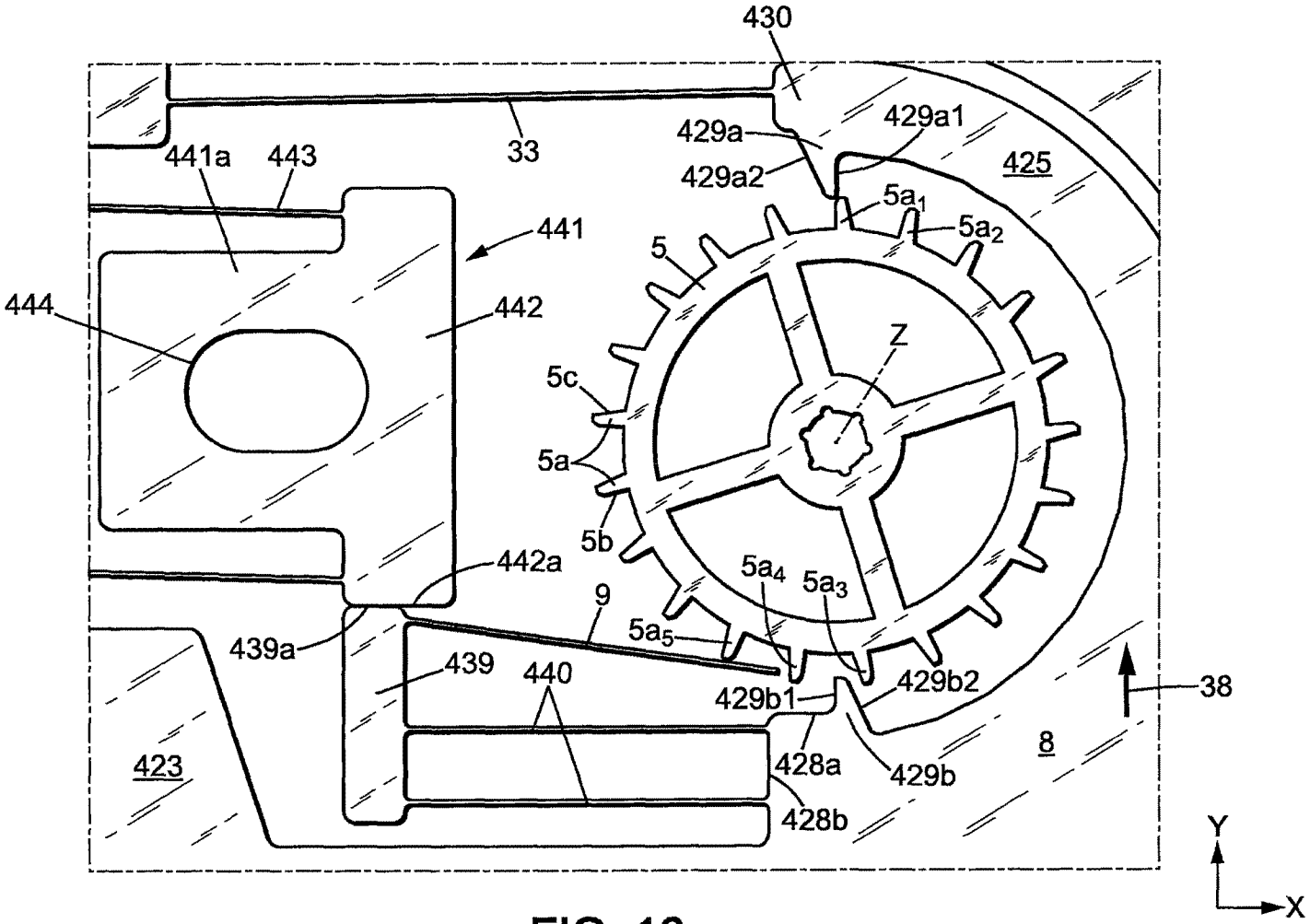

The regulating member 17 and blocking member 8 then change their direction of movement, and the mechanism arrives in the position of FIGS. 16, 16*a*, where:

- regulating member 17 moves toward side 13 in the direction of arrow 37, and arrives close to neutral position;
- blocking member 8 moves toward side 15 in the direction of arrow 38 and arrives in the first escape position where energy distribution wheel 5 will be released by the first stop member 429*a* and turn of one angular step in the direction of arrow 36;
- second stop member 429*b* is already between two teeth $5a_3$, $5a_4$ of the energy distribution wheel 5, close to the rear face 5*c* of one of these teeth 5*a;*
- flexible tongue 9 arrives in contact with tooth $5a_5$ of the energy distribution wheel 5 but is not yet flexed;
- decoupled support 439 is already in contact with stop 441.

Figure 17:
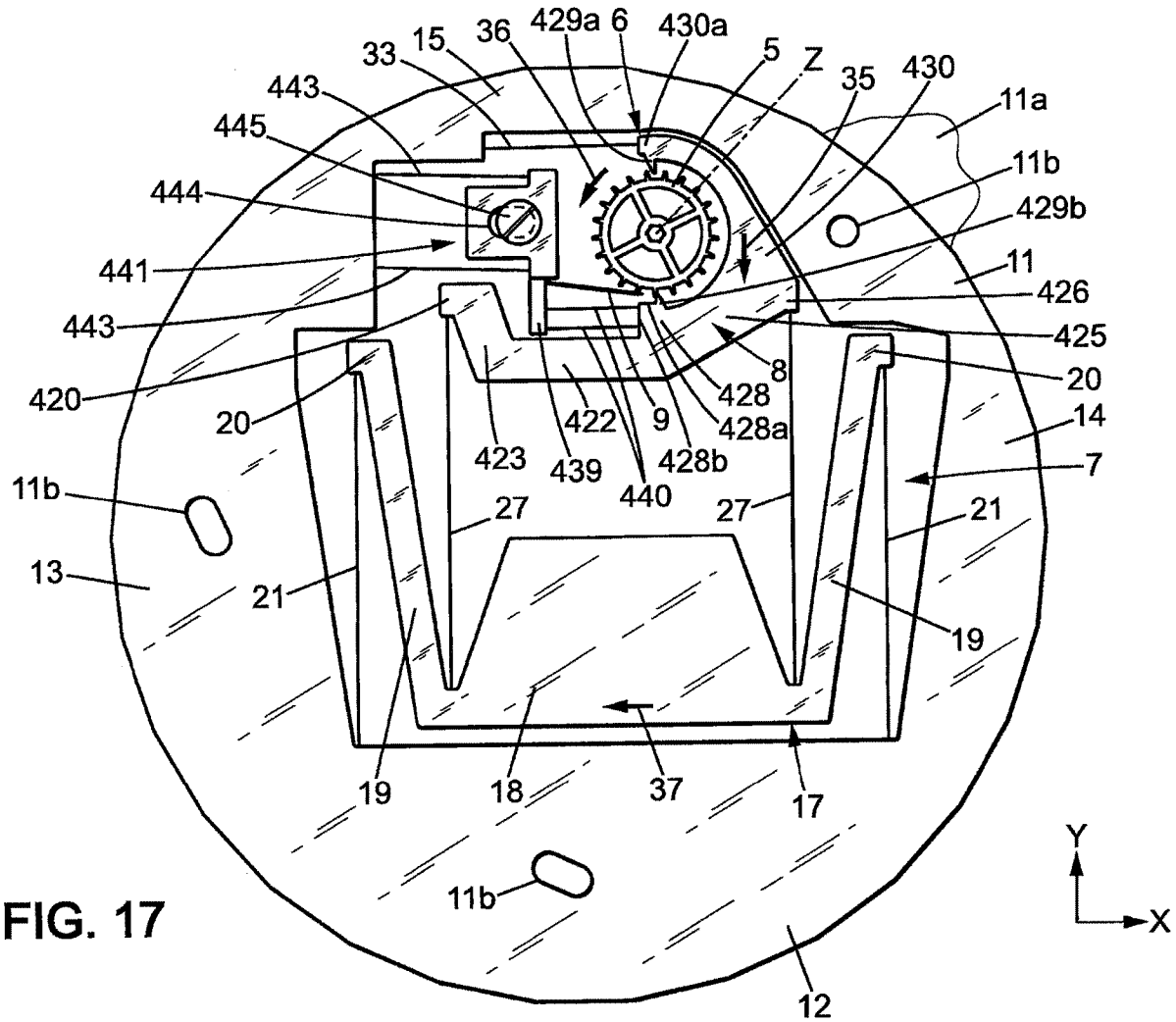
Figure 17A:
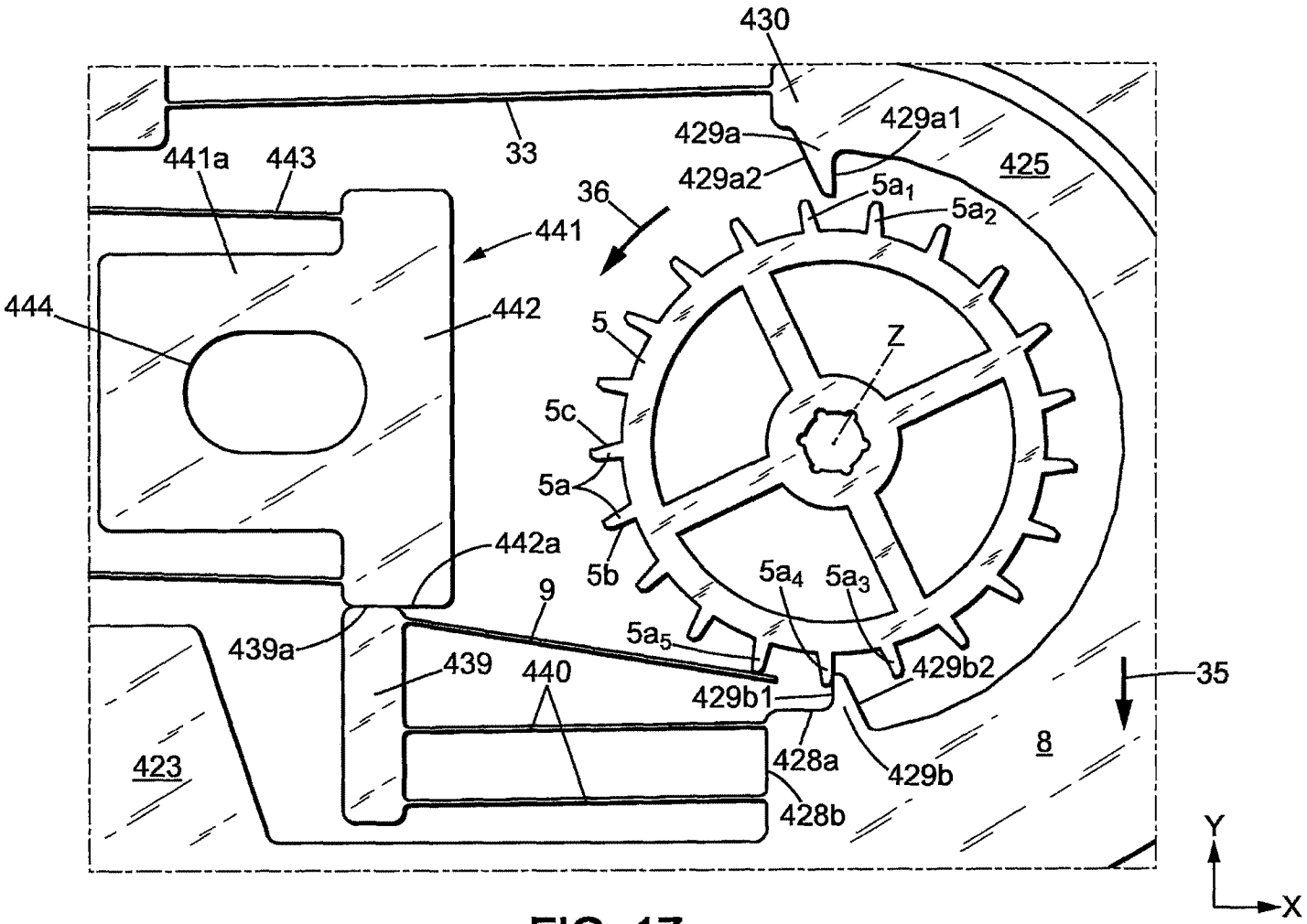

The energy distribution wheel 5 then quickly turns of one angular step in the direction of rotation 36 and the mechanism arrives in the position of FIGS. 17, 17*a*, where:

- regulating member 17 still moves toward side 13 in the direction of arrow 37, and is still close to neutral position;
- blocking member 8 is close to the second blocking member and already moves toward side 12 in the direction of arrow 35;
- first stop member 429*a* does not interfere with the energy distribution wheel 5 and is situated angularly between teeth $5a_1$ and $5a_2$;
- second stop member 429*b* holds the energy distribution wheel 5 by abutment with the front face of tooth $5a_4$;
- flexible tongue 9 is in the second geometrical configuration, flexed at the maximum by tooth $5a_5$;
- decoupled support 439 is still in abutment against stop 441, the elastic links 44 having sufficient rigidity to maintain decoupled support 439 in abutment against stop 441 while flexible tongue 9 is flexed.

Figure 18:
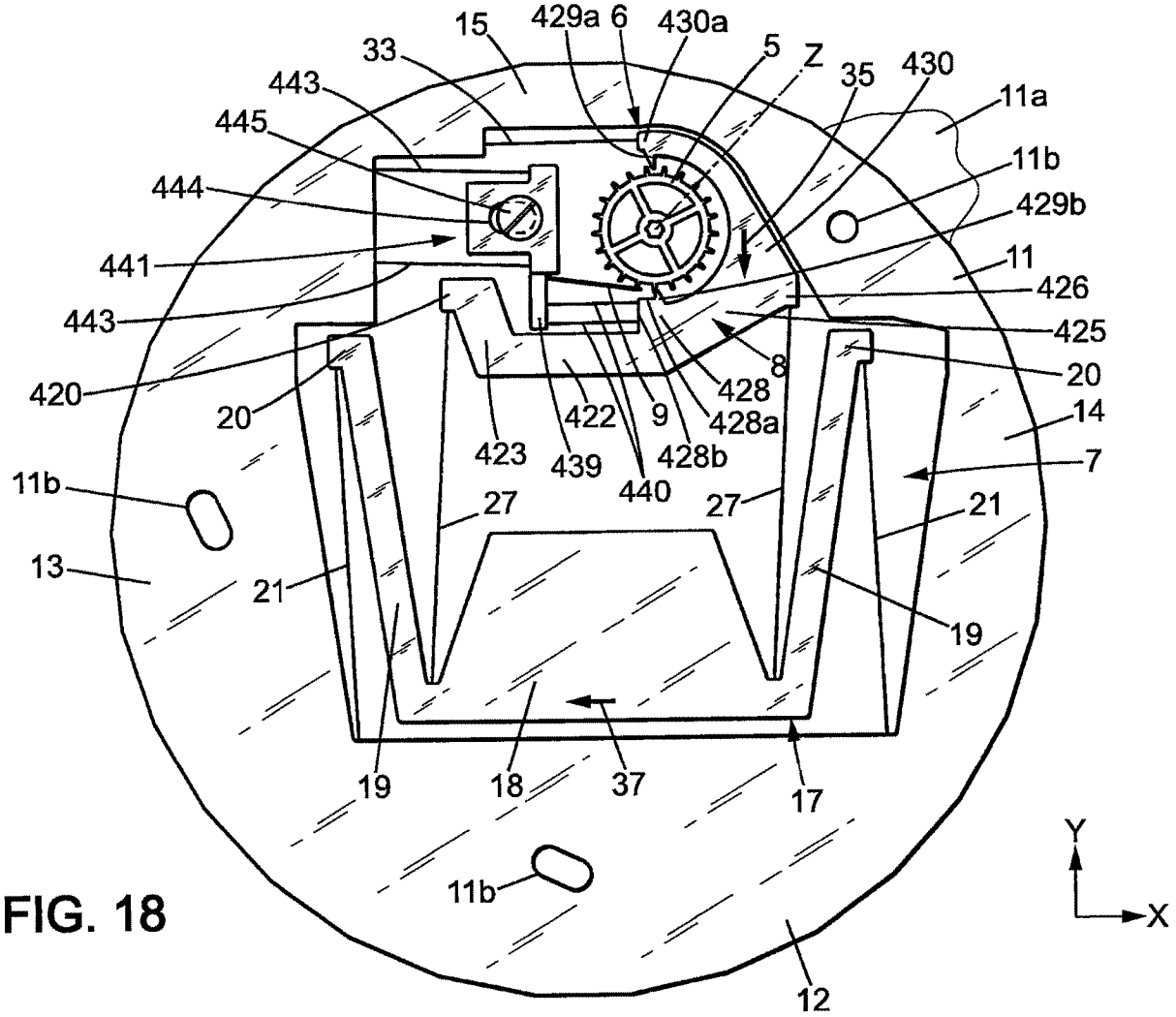
Figure 18A:
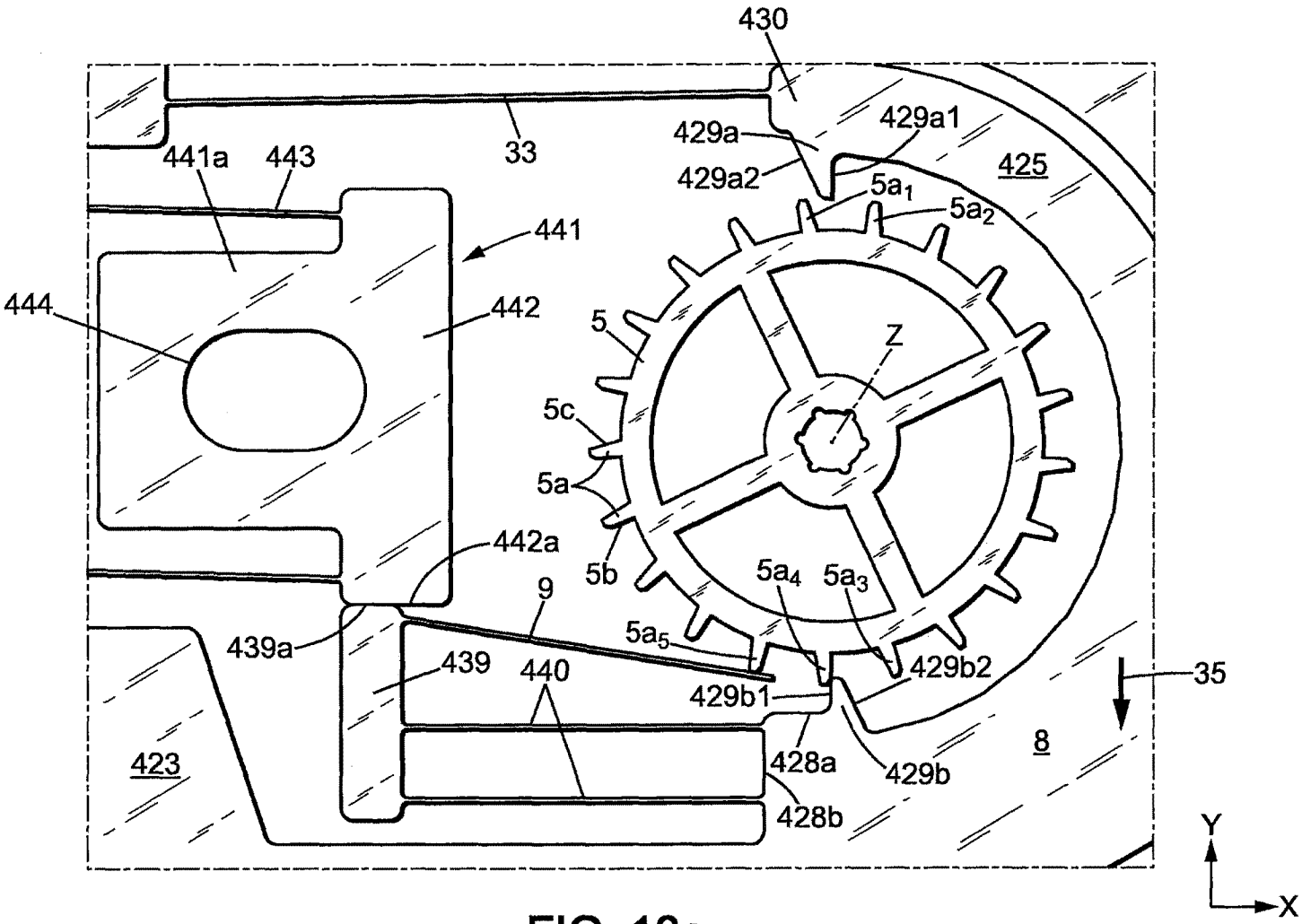

The mechanism then arrives in the position of FIGS. 18, 18*a*, where:

- regulating member 17 still moves toward side 13 in the direction of arrow 37;
- blocking member 8 still moves toward side 12 in the direction of arrow 35;
- first stop member 429*a* is already between teeth 5*a*1 and $5a_2$ of the energy distribution wheel 5, close to the rear face 5*c* of tooth $5a_1$;
- flexible tongue 9 has released its energy and has returned to the first (non-flexed) geometrical configuration;
- decoupled support 439 starts separating from stop 441.

Figure 19:
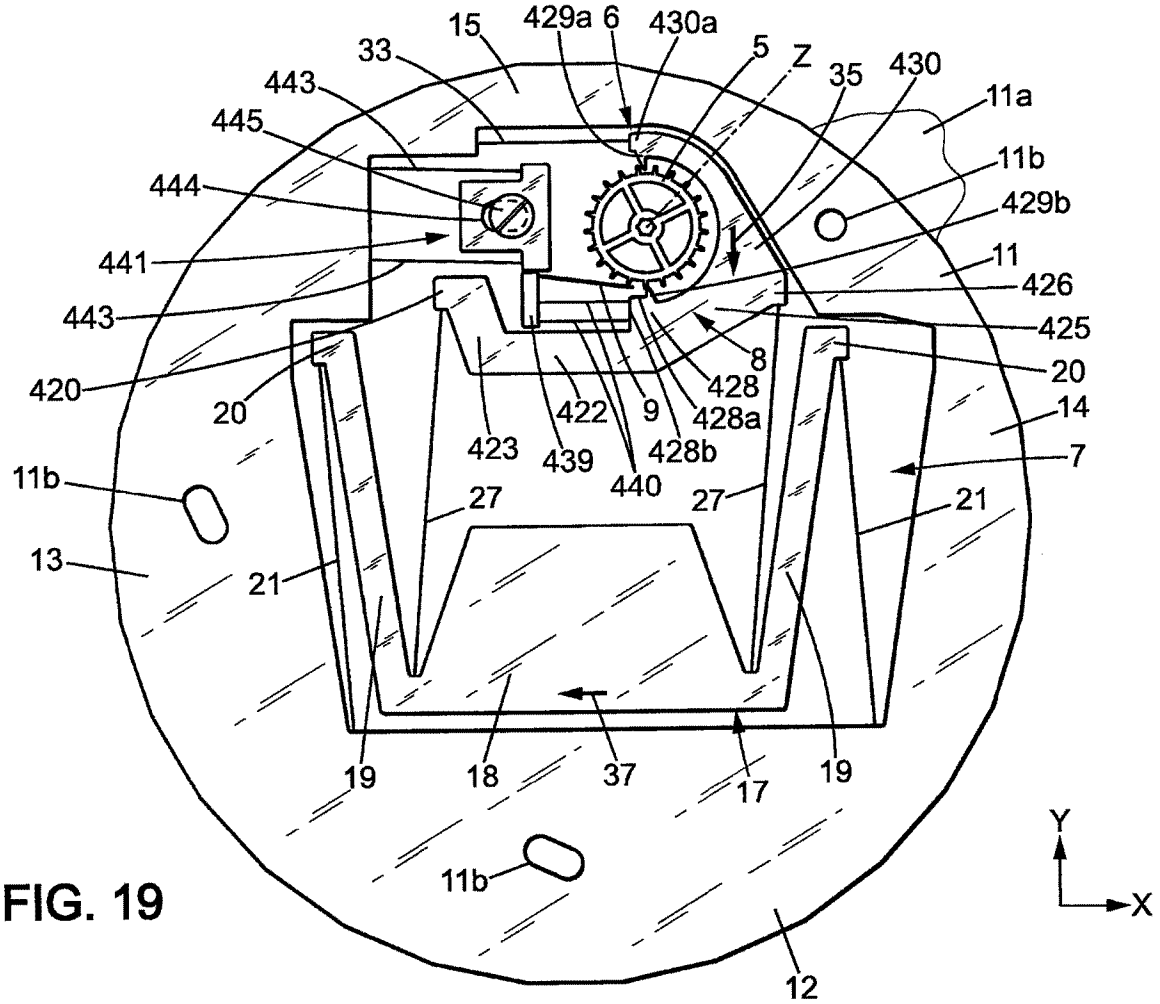
Figure 19A:
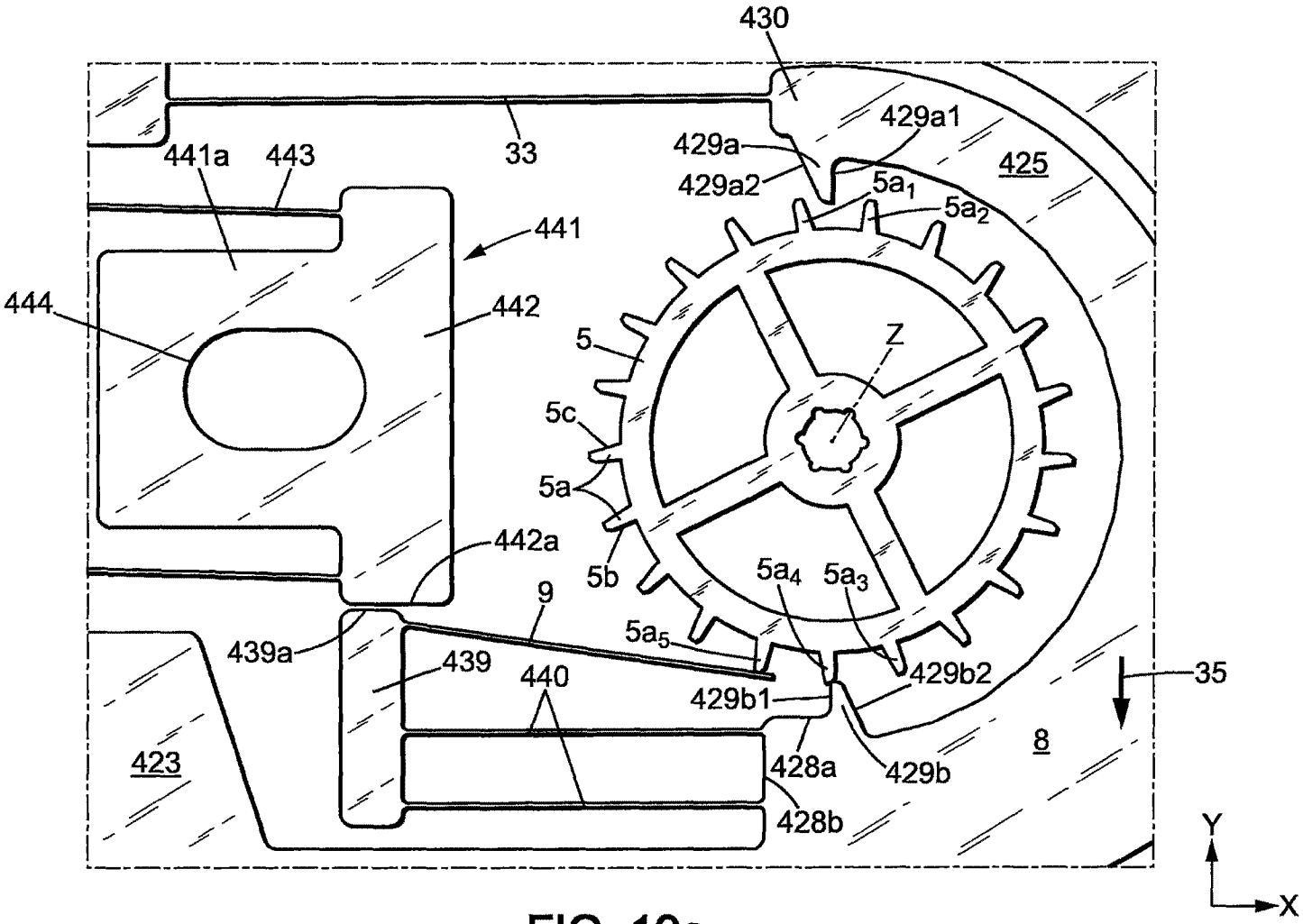

The mechanism then arrives in the position of FIGS. 19, 19*a*, where:

- regulating member 17 still moves toward side 13 in the direction of arrow 37;
- blocking member 8 still moves toward side 12 in the direction of arrow 35 and arrives in the second escape position where energy distribution wheel 5 will be released by the second stop member 429*b* and will turn of one angular step in the direction of arrow 36;

first stop member 429*a* is still between teeth 5*a*1 and 5*a*$_2$ of the energy distribution wheel 5, close to the rear face 5*c* of tooth 5*a*$_1$;

flexible tongue 9 is in the first (non-flexed) geometrical configuration;

decoupled support 439 is separated from stop 441.

Figure 20:
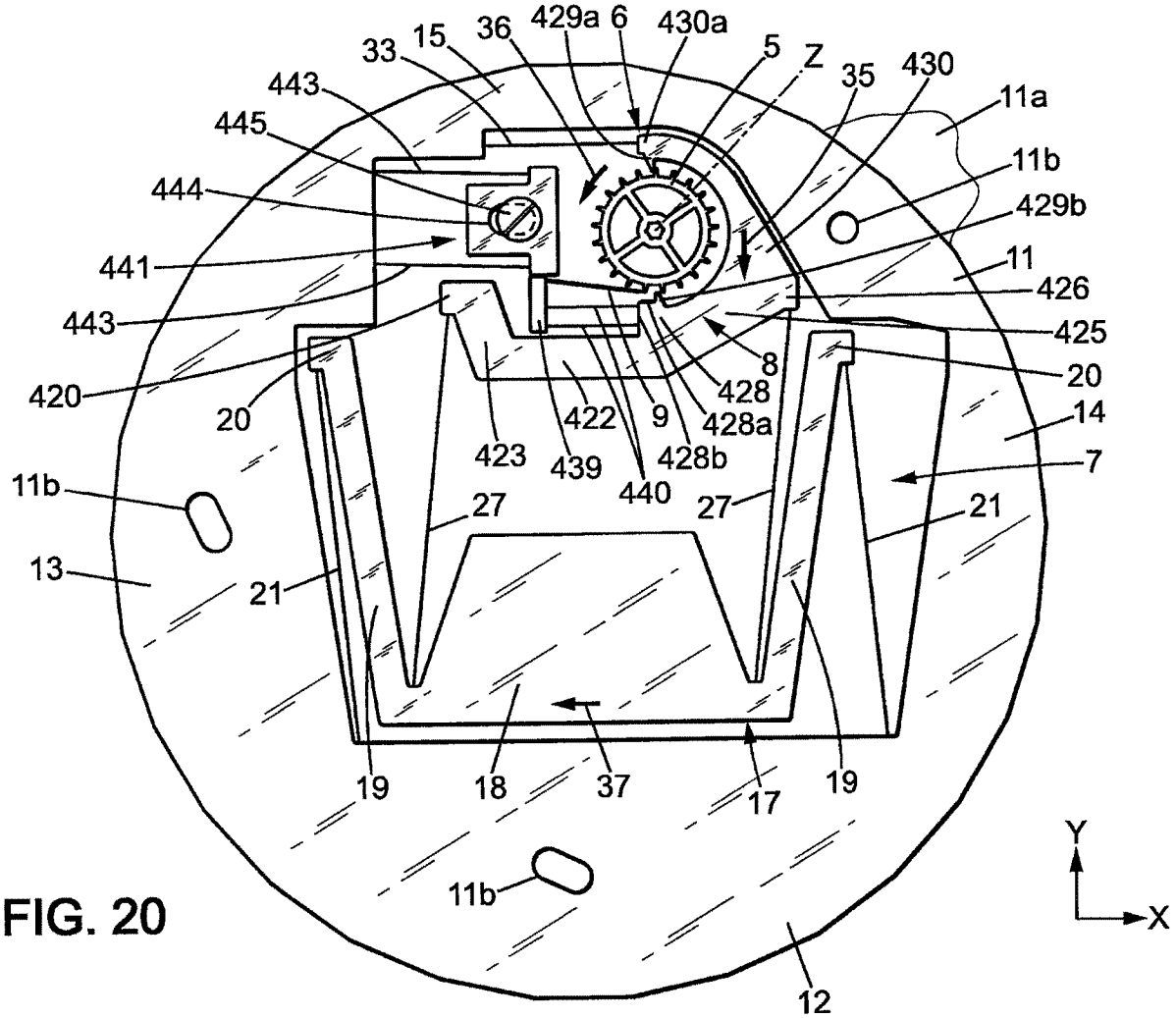
Figure 20A:
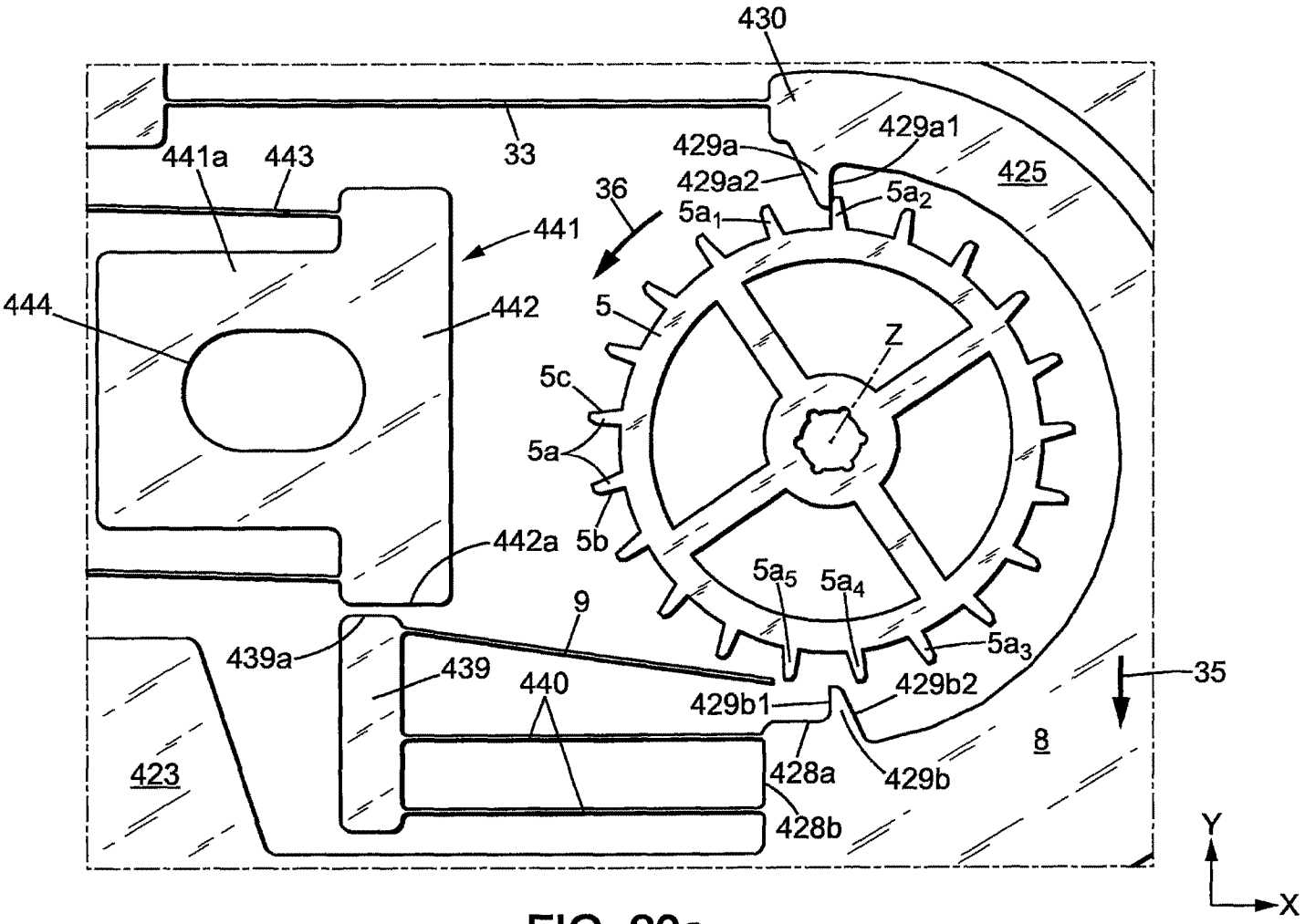

After the energy distribution wheel has turned of one angular step, the mechanism then arrives in the position of FIGS. 20, 20*a*, where:

regulating member 17 still moves toward side 13 in the direction of arrow 37, and is close to the first extreme regulating member position;

blocking member 8 still moves toward side 12 in the direction of arrow 35 and arrives close to the first extreme blocking member position;

energy distribution wheel 5 is held by the first stop member 429*a;* flexible tongue 9 is in the first (non-flexed) geometrical configuration;

decoupled support 439 is still separated from stop 441.

The regulating member 17 and blocking member 8 then change direction and the same steps occur until the mechanism reaches back the position of FIGS. 14, 14*a*, and then the cycle is repeated.

The invention claimed is:

1. A mechanism for a timepiece, comprising:

a regulator mechanism adapted to oscillate with a periodical movement;

an energy distribution member having teeth;

a blocking mechanism cooperating with the energy distribution member, said blocking mechanism being controlled by the regulator mechanism to regularly and alternatively hold and release the energy distribution member so that said energy distribution member may move step by step according to a repetitive movement cycle;

a monostable elastic member linked to the regulator mechanism and adapted to bear on the teeth of the energy distribution member, said monostable elastic member normally having a first geometrical configuration, said monostable elastic member being arranged such that during each movement cycle of the energy distribution member:

one tooth of said energy distribution member elastically deforms said monostable elastic member from said first geometrical configuration;

and then said monostable elastic member elastically returns to the first geometrical configuration, thereby releasing mechanical energy to the regulator mechanism wherein the regulator mechanism has an inertial regulating member which is mounted on a support by a first elastic suspension and the blocking mechanism has a blocking member which is connected to the regulating member by at least an elastic link so as to move in synchronism with said regulating member, said blocking member being connected to the monostable elastic member and cooperating with the energy distribution member to alternatively hold and release said energy distribution member.

2. A mechanism (10) according to claim 1, wherein said monostable elastic member is arranged such that during each movement cycle of the energy distribution member, one tooth of said energy distribution member elastically deforms said monostable elastic member from said first geometrical configuration to a predetermined, second geometrical configuration of the monostable elastic member, said second geometrical configuration being the same for all movement cycles of the energy distribution member, whereby said monostable elastic member releases a predetermined, constant amount of mechanical energy to the regulator mechanism when it elastically returns to the first geometrical configuration.

3. A mechanism (10) according to claim 1, wherein said energy distribution member is a rotary energy distribution wheel.

4. A mechanism (10) according to claim 1, wherein said monostable elastic member is a flexible tongue which has a first end linked to the regulator mechanism and a second, free end bearing on the teeth of the energy distribution wheel.

5. A timepiece having a mechanism according to claim 1.

6. A mechanism according to claim 1, wherein said blocking member is connected to the regulating member so as to oscillate with a frequency twice an oscillation frequency of the regulating member.

7. A mechanism according to claim 6, wherein the regulating member and the first elastic suspension are arranged so that said regulating member oscillates in two directions from a neutral position, between first and second extreme regulating member positions, the blocking member is mounted to oscillate between first and second extreme locking member positions, and the elastic link is arranged such that:

the blocking member is moved to the second extreme blocking member position by the elastic link when the regulating member is in the neutral position; and the blocking member is moved to the first extreme blocking member position by the elastic link when the regulating member is in any of the first and second extreme regulating member positions.

8. A mechanism according to claim 7, wherein said energy distribution member is a rotary energy distribution wheel and said blocking member has first and second stop members which are arranged to interfere in turn with said teeth of the energy distribution wheel so as to hold said energy distribution wheel respectively when said blocking member is in the first and second extreme blocking member positions, said first stop member being arranged to not interfere with the energy distribution wheel when the blocking member is between a first escape position and the second extreme blocking member position, and said second stop member being arranged to not interfere with the energy distribution wheel when the blocking member is between a second escape position and the first extreme blocking member position.

9. A mechanism according to claim 8, wherein the energy distribution wheel is movable in a direction of rotation and the teeth of said energy distribution wheel have respectively a front face facing the direction of rotation and a rear face opposite the direction of rotation, and the first and second stop members are arranged such that:

when said blocking member is in the first escape position and the first stop member is in correspondence with the front face of a tooth, the second stop member is between two other teeth of the energy distribution wheel, in the vicinity of the rear face of one of these two other teeth;

when said blocking member is in the second escape position and the second stop member is in correspondence with the front face of a tooth, the first stop member is between two other teeth (5*a*) of the energy distribution wheel, in the vicinity of the rear face of one of these two other teeth.

10. A mechanism according to claim 9, further including biasing means (2) for biasing the energy distribution wheel in rotation through a mechanical transmission, in a single direction of rotation, and wherein said transmission is arranged such that each rotation step of the energy distribution wheel is completed in a time which is not longer than a time necessary for the blocking member to travel from the first escape position to the second extreme blocking member position.

11. A mechanism according to claim 8, wherein said monostable elastic member is arranged such that the teeth of the energy distribution wheel elastically deform said monostable elastic member from said first geometrical configuration to said second geometrical configuration during rotation of the energy distribution wheel (5) when the blocking member is between the first escape position and the second extreme blocking member position.

12. A mechanism according to claim 11, wherein the monostable elastic member is arranged such that said monostable elastic member is in the second geometrical configuration when the blocking member is in the second extreme blocking member position, whereby the monostable elastic member returns to the first geometric configuration and then transfers said predetermined amount of mechanical energy to the blocking member during movement of the blocking member from the second extreme blocking member position to the second escape position, the elastic link being arranged to transmit said predetermined amount of mechanical energy to the regulating member.

13. A mechanism according to claim 12, wherein the monostable elastic member is arranged not to interfere with the teeth of the energy distribution wheel while the blocking member moves from the second escape position to the first extreme blocking member position and from said first extreme blocking member position to the first escape position.

14. A mechanism according to claim 8, wherein the monostable elastic member is mounted on the blocking member adjacent the second stop member.

15. A mechanism according to claim 14, said energy distribution member is a rotary energy distribution wheel and wherein said first and second stop members and said second elastic suspension are arranged such that said first and second stop members move substantially radially with regard to the energy distribution wheel, alternately toward and away from said energy distribution wheel.

16. A mechanism according to claim 1, wherein said blocking member is mounted on the support by a second elastic suspension.

17. A mechanism according to claim 16, wherein said first elastic suspension is arranged to impose either a translational movement, or a rotational movement to the regulating member, and said second elastic suspension is arranged to impose either a translational movement, or a rotational movement to the blocking member.

18. A mechanism according to claim 17, wherein said first elastic suspension is arranged to impose a translational movement to the regulating member in a first direction, and said second elastic suspension is arranged to impose a translational movement to the blocking member in a second direction substantially perpendicular to said first direction.

19. A mechanism according to claim 18, wherein the first elastic suspension comprises two flexible, first elastic branches extending substantially parallel to the second direction and the second elastic suspension comprises two flexible, second elastic branches extending substantially parallel to the first direction, and the blocking member is connected to the regulating member by at least two flexible elastic links extending substantially parallel to the second direction.

20. A mechanism according to claim 19, wherein said first elastic branches and said flexible elastic links are arranged to be substantially rectilinear when the regulating member is in neutral position.

21. A mechanism according to claim 1, wherein the regulator mechanism, the blocking mechanism and the monostable elastic member are a monolithic system made in a single plate and designed to move essentially in a mean plane of said plate.

22. A mechanism for a timepiece, comprising:

a regulator mechanism adapted to oscillate with a periodical movement;

an energy distribution member having teeth;

a blocking mechanism cooperating with the energy distribution member, said blocking mechanism being controlled by the regulator mechanism to regularly and alternatively hold and release the energy distribution member so that said energy distribution member may move step by step according to a repetitive movement cycle;

a monostable elastic member linked to the regulator mechanism and adapted to bear on the teeth of the energy distribution member, said monostable elastic member normally having a first geometrical configuration, said monostable elastic member being arranged such that during each movement cycle of the energy distribution member:

one tooth of said energy distribution member elastically deforms said monostable elastic member from said first geometrical configuration;

and then said monostable elastic member elastically returns to the first geometrical configuration, thereby releasing mechanical energy to the regulator mechanism, said mechanism including a fixed stop having a predetermined position relative to a support on which the energy distribution member is mounted, wherein the monostable elastic member is connected to a decoupled support which is elastically linked to the regulator mechanism by an elastic connection, wherein said stop is positioned so as to stop said decoupled support as long as one tooth of said energy distribution member elastically deforms said monostable elastic member from said first geometrical configuration, and wherein said elastic connection is rigid enough to maintain said decoupled support in abutment with said stop while said energy distribution member elastically deforms said monostable elastic member.

23. A mechanism according to claim 22, wherein the regulator mechanism has an inertial regulating member which is mounted on a support by a first elastic suspension and the blocking mechanism has a blocking member which is connected to the regulating member by at least an elastic link so as to move in synchronism with said regulating member, said blocking member being connected to the monostable elastic member and cooperating with the energy distribution member to alternatively hold and release said energy distribution member, and wherein the decoupled support is elastically linked to the blocking member by said elastic connection.

24. A mechanism according to claim 22, wherein the position of said stop is adjustable relative to the support.

* * * * *